US008805617B2

(12) United States Patent
Zuo et al.

(10) Patent No.: US 8,805,617 B2
(45) Date of Patent: Aug. 12, 2014

(54) METHODS AND APPARATUS FOR CHARACTERIZATION OF PETROLEUM FLUIDS CONTAMINATED WITH DRILLING MUD

(75) Inventors: Youxiang (Jullan) Zuo, Edmonton (CA); Dingan (Dan) Zhang, Edmonton (CA); Dong Chengli, Sugar Land, TX (US); Oliver C. Mullins, Ridgefield, CT (US); Michael O'Keefe, Blackmans Bay (AU)

(73) Assignee: Schlumberger Technology Corporation, Sugar Land, TX (US)

( * ) Notice: Subject to any disclaimer, the term of this patent is extended or adjusted under 35 U.S.C. 154(b) by 840 days.

(21) Appl. No.: 12/990,980

(22) PCT Filed: May 6, 2009

(86) PCT No.: PCT/IB2009/051867

§ 371 (c)(1),
(2), (4) Date: Dec. 10, 2010

(87) PCT Pub. No.: WO2009/138911

PCT Pub. Date: Nov. 19, 2009

(65) Prior Publication Data

US 2011/0088949 A1 Apr. 21, 2011

Related U.S. Application Data

(60) Provisional application No. 61/052,677, filed on May 13, 2008.

(51) Int. Cl.
*G01V 1/00* (2006.01)

(52) U.S. Cl.
USPC ..... 702/11; 702/10; 702/179

(58) Field of Classification Search
USPC ..... 702/11, 10, 179; 250/255, 256, 343; 73/152.02, 152.54, 152.55
See application file for complete search history.

(56) References Cited

U.S. PATENT DOCUMENTS 6,178,815 B1 1/2001 Felling et al.
6,274,865 B1 8/2001 Schroer et al.

(Continued)

FOREIGN PATENT DOCUMENTS

GB 2442087 A 3/2008

OTHER PUBLICATIONS

Gozalpour et al, Predicting Reservoir Fluid Phase and Volumetric Behavior From Samples Contaminated with Oil-Based Mud, Spe Reservoir Evaluation & Engineering, Jun. 2002, pp. 197-205.

(Continued)

*Primary Examiner* — Elias Desta
(74) *Attorney, Agent, or Firm* — Cathy Hewitt

(57) ABSTRACT

A method and system for characterizing formation fluids contaminated with drilling mud that compensates for the presence of such drilling mud. The operations that characterize formation fluids contaminated with drilling mud can be carried out in real-time. The operations also characterize a wide array of fluid properties of petroleum samples contaminated with drilling mud in a manner that compensates for the presence of drilling mud. The operations characterize the viscosity and density of petroleum samples contaminated with drilling mud at formation conditions in a manner that compensates for differences between formation conditions and flowline measurement conditions. The operations also derive live fluid density unaffected by contamination of mud filtrate based on a scaling coefficient dependent on measured gas-oil ratio of the formation fluid. This scale factor accounts for excess volume created during mixing processes, which increases the accuracy of characterizations for high gas-oil ratio samples, especially gas condensate.

39 Claims, 7 Drawing Sheets

(56) References Cited

U.S. PATENT DOCUMENTS

| | | | | |
|---|---|---|---|---|
| 6,343,507 | B1 | 2/2002 | Felling et al. | |
| 6,350,986 | B1 | 2/2002 | Mullins et al. | |
| 7,134,500 | B2 | 11/2006 | Ramakrishnan et al. | |
| 7,249,009 | B2 | 7/2007 | Ferworn et al. | |
| 7,461,547 | B2 * | 12/2008 | Terabayashi et al. | 73/152.55 |
| 7,526,953 | B2 * | 5/2009 | Goodwin et al. | 73/152.28 |
| 2004/0000400 | A1 | 1/2004 | Fujisawa et al. | |
| 2005/0216196 | A1 | 9/2005 | Akkurt et al. | |
| 2006/0155472 | A1 | 7/2006 | Venkataramanan et al. | |
| 2009/0030858 | A1 | 1/2009 | Hegeman et al. | |
| 2009/0192768 | A1 | 7/2009 | Zuo et al. | |

OTHER PUBLICATIONS

Schlumberger Brochure, "Oil-Base Mud Contamination Alalysis", Schlumberger Copyright 2007, p. 1.

Zuo, et al "Plus Fraction Characterization and PVT Data Regression for Reservoir Fluids Near Critical Conditions", Society of Petroleum Engineers Inc. 64520, Oct. 2000, pp. 1-12.

Parashar, et al, "A New Generation EOS Compositional Reservoir Simulator: Part II—Framework and Multiprocessing", Copyright 1997, Society of Petroleum Engineers, Inc. SPE 37977, pp. 1-8.

Andrews, John R. et al, "Quantifying Contamination Using Color of Crude and Condensate", Oilfield Rreview Autumn 2001, pp. 24-43.

Barrufet, Maria A. et al, "Reliable Heavy Oil-Solvent Viscosity up to 450k, Oil—Solvent Viscosity ratios Up to 4*10e-5, and any Solvent Proportion, Fluid Phase Equilibria" 213 (2003) 65-79, Petroleum Engineering Department, Texas.

Schlumberger Brochure, Insitu Fluid Analyzer, "Quantitative Fluid Measurements at Reservoir Conditions, in Real Time", copyright 2009 pp. 1-8.

Schlumberger Brochure, LFA Live Fluid Analyzer "Confidence in Sampling", SMP-5820, Copyright Sep. 2001, pp. 1-5.

Schlumberger Brochure, MDT Modular Formation Dynamics Tester "Quality Fluid Samples and Highly Accurate Reservoir Pressures", SMP-5124 copyright Jun. 2002.

Schlumberger Brochure, Quick Silver Probe, copyright 07-FE036, 2007, p. 1-8.

Focke, Walter W. et al, "Weighted-Power-Mean Mixture Model: Application to Multicomponent Liquid Viscosity", Industry and Engineering Chemistry Research, vol. 46, pp. 4660-4666, 2007.

Mullins, Oliver C. et al, "Real-Time Quantification of OBM Filtrate Contamination During Openhole Wireline Sampling by Optical Spectroscopy", Annual Logging Symposium SPWLA 41st, Jun. 4-7, 2000.

Mullins, Oliver C. et al, "Downhole Determination of GOR on Single-Phase Fluids by Optical Spectroscopy", SPWLA 42nd Annual Logging Symposium, Jun. 17-20, 2001.

Lide, David R., ed., "CRC Handbook of Chemistry and Physics", 88th Edition (Internet Version 2008), CRC Press/Taylor and Francis, Boca Raton, FL, 2008.

Dong, C. et al, "New Downhole fluid Analyzer Tool for Improved Reservoir Characterization", Copyright 2007, Society of Petroleum Engineers, Presented at Offshore Europe 2007 held in Aberdeen, Scotland, U.K. Sep. 7, 2007.

* cited by examiner

METHODS AND APPARATUS FOR CHARACTERIZATION OF PETROLEUM FLUIDS CONTAMINATED WITH DRILLING MUD

CROSS-REFERENCE TO RELATED APPLICATIONS

This application is a national stage entry of PCT Application No. PCT/IB2009/051867, filed on May 6, 2009, which claims priority to U.S. Provisional Application No. 61/052,677, filed on May 13, 2008.

BACKGROUND OF THE INVENTION

1. Field of the Invention

The present invention relates to methods and apparatus for characterizing petroleum fluid extracted from a hydrocarbon bearing geological formation.

2. Description of Related Art

Petroleum consists of a complex mixture of hydrocarbons of various molecular weights, plus other organic compounds. The exact molecular composition of petroleum varies widely from formation to formation. The proportion of hydrocarbons in the mixture is highly variable and ranges from as much as 97 percent by weight in the lighter oils to as little as 50 percent in the heavier oils and bitumens. The hydrocarbons in petroleum are mostly alkanes (linear or branched), cycloalkanes, aromatic hydrocarbons, or more complicated chemicals like asphaltenes. The other organic compounds in petroleum typically contain carbon dioxide ($CO_2$), nitrogen, oxygen, and sulfur, and trace amounts of metals such as iron, nickel, copper, and vanadium.

The alkanes, also known as paraffins, are saturated hydrocarbons with straight or branched chains which contain only carbon and hydrogen and have the general formula $C_nH_{2n+2}$. They generally have from 5 to 40 carbon atoms per molecule, although trace amounts of shorter or longer molecules may be present in the mixture. The alkanes include methane ($CH_4$), ethane ($C_2H_6$), propane ($C_3H_8$), i-butane ($iC_4H_{10}$), n-butane ($nC_4H_{10}$), i-pentane ($iC_5H_{12}$), n-pentane ($nC_5H_{12}$), hexane ($C_6H_{14}$), heptane ($C_7H_{16}$), octane ($C_8H_{18}$), nonane ($C_9H_{20}$), decane ($C_{10}H_{22}$), hendecane ($C_{11}H_{24}$)— also referred to as endecane or undecane, dodecane ($C_{12}H_{26}$), tridecane ($C_{13}H_{28}$), tetradecane ($C_{14}H_{30}$), pentadecane ($C_{15}H_{32}$), and hexadecane ($C_{16}H_{34}$).

The cycloalkanes, also known as napthenes, are saturated hydrocarbons which have one or more carbon rings to which hydrogen atoms are attached according to the formula $C_nH_{2n}$. Cycloalkanes have similar properties to alkanes but have higher boiling points. The cycloalkanes include cyclopropane ($C_3H_6$), cyclobutane ($C_4H_8$), cyclopentane ($C_5H_{10}$), cyclohexane ($C_6H_{12}$), cycloheptane ($C_7H_{14}$), etc.

The aromatic hydrocarbons are unsaturated hydrocarbons which have one or more planar six-carbon rings called benzene rings, to which hydrogen atoms are attached with the formula $C_nH_n$. They tend to burn with a sooty flame, and many have a sweet aroma. Some are carcinogenic. The aromatic hydrocarbons include benzene ($C_6H_6$) and derivatives of benzene, as well as polyaromatic hydrocarbons.

Computer-based modeling and simulation techniques have been developed for estimating the properties and/or phase behavior of petroleum fluid in a reservoir of interest. Typically, such techniques employ a borehole sampling and analysis tool that samples petroleum fluid and analyzes the petroleum fluid at downhole conditions to derive properties of the sampled petroleum fluid at such downhole conditions.

Examples of such borehole sampling and analysis tools include the Modular Formation Dynamics Tester (MDT) tool with downhole fluid analysis (DFA) module available from Schlumberger Technology Corporation of Sugar Land, Tex., USA, the SampleView Reservoir Characterization Instrument available from Baker Hughes, Inc. of Houston, Tex., USA, and the Reservoir Description Tool available from Halliburton Company of Houston, Tex., USA. As an example, the fluid properties measured by the MDT tool include weight fractions of the hydrocarbon components of the fluid, live fluid density, live fluid viscosity, gas-oil ratio (GOR), volumetric factors, flowline temperature and pressure, and formation temperature and pressure. Such fluid properties are typically used in conjunction with an equation of state (EOS) model that represents the phase behavior of the petroleum fluid in the reservoir to characterize a wide array of properties of the petroleum fluid of the reservoir. The EOS model and calculations based thereon can be extended to characterize the reservoir properties over time during planned production in order to simulate and analyze production scenarios for reservoir planning and optimization. A detailed description of reservoir fluid properties is desirable for an accurate modeling of the fluids in the reservoir. Indeed, decisions such as the type of well completion, production procedures, and the design of the surface handling and processing facilities are affected by the characteristics of the produced fluids.

Difficulties in accurately estimating the properties of petroleum fluid arise from the fact that the petroleum fluid samples captured by the borehole sampling and analysis tool are likely contaminated with drilling mud. More particularly, a borehole is drilled into the formation in order to provide access for the borehole sampling and analysis tool. During such drilling, mud is pumped into the borehole. The mud serves several purposes. It acts as a buoyant medium, cuttings transporter, lubricant, and coolant, as well as a medium through which downhole telemetry may be achieved. The mud is usually kept overbalanced, i.e. at a higher pressure than the pressure of the formation fluids. This leads to "invasion" of mud filtrate into the formation fluids and the buildup of mudcake on the borehole wall. There are three different mud types: water-based mud (WBM), oil-based mud (OBM), and synthetic-based mud (SBM). Water-based mud can be realized by, but are not limited to, freshwater, seawater, saltwater (brine) and others, or a combination of any of these fluids. Oil-based mud is an oil product, such as diesel or mineral oil. Synthetic-based mud can be realized, without limitation, by olefinic-, naphthenic-, and paraffinic-based compounds.

Water-based mud and aquifer water may form emulsions with formation petroleum fluids as a result of high speed drilling operations. When samples are taken, the samples are contaminated with the emulsified mud filtrate and even a small quantity of such mud filtrate in a sample can alter the properties of the fluid sample as measured by the tool.

For oil-based mud and synthetic-based mud, the mud filtrate may miscibly mix with the formation petroleum fluid. When samples are taken, the samples are contaminated with the mud filtrate and even a small quantity of such mud filtrate in a sample can alter the properties of the fluid sample as measured by the tool.

There are prior art techniques for estimating such mud filtrate based on the optical properties of the fluids flowing through a tool. More particularly, a fluid analysis module can measure the absorption spectrum of the formation fluid and use physical and empirical models in conjunction with the measured absorption spectrum to estimate the mud filtrate fraction, control sampling based thereon, and determine GOR of the formation fluid corrected for mud filtrate contamination. See, e.g., U.S. Pat. Nos. 6,178,815; 6,274,865; 6,343,507 and 6,350,986. Such techniques have several limitations, including the generation of a limited data set (e.g., mud filtrate fraction, GOR) that characterizes properties of the formation fluid in a real-time manner. Instead, other fluid properties of interest can be derived with significant delay, which typically results from a time period required to allow non-contaminated petroleum fluid to be sampled and analyzed by the tool.

In another example, U.S. Pat. No. 7,134,500 discloses a method for characterizing formation fluid using flowline viscosity and density data in an oil-based mud environment. However, this method has several limitations. First, it requires computational analysis of a one-dimensional column of measurements of density, viscosity, volume fraction of water, and volume fraction of mud filtrate over a number of samples that cannot be applied in real-time. Second, the method employs mixing rules that ignore excess volume created during mixing processes and cannot generate accurate fluid properties for high GOR systems, especially gas condensate. Third, the method usually calculates much higher density of oil-based mud than the actual experimental value.

BRIEF SUMMARY OF THE INVENTION

In accordance with the present invention, a methodology and system for characterizing the fluid properties of petroleum samples contaminated with drilling mud is provided which substantially eliminates the limitations and problems associated with such prior art techniques.

More particularly, the present invention provides a methodology and system for characterizing the fluid properties of petroleum samples contaminated with drilling mud in a manner that compensates for the presence of such drilling mud. Such methodology and system characterizes the fluid properties of petroleum samples contaminated with drilling mud in a real-time manner and thus avoids the computational delays associated with the prior art.

The present invention also provides a methodology and system that characterizes a wide array of fluid properties of petroleum samples contaminated with drilling mud in a manner that compensates for the presence of such drilling mud.

The present invention also provides a methodology and system that characterizes the viscosity and density of petroleum samples contaminated with drilling mud at formation conditions in a manner that compensates for differences between flowline measurement conditions and formation conditions.

The present invention also provides a methodology and system that characterizes the fluid properties of petroleum samples contaminated with drilling mud in a manner that accounts for excess volume created during mixing processes, which increases the accuracy of such characterizations for high GOR samples, especially gas condensate.

The present invention, which will be discussed in detail below, includes a method and system for characterizing formation fluid in an earth formation surrounding a borehole drilled into the earth formation whereby formation fluid is sampled at a given location within the borehole by drawing formation fluid into a flowline disposed within the borehole. The formation fluid is analyzed in the flowline to derive first data characterizing properties of the formation fluid in the flowline. The first data includes data representing temperature and pressure of the formation fluid in the flowline. A data processing system operates on the first data to derive second data characterizing a plurality of properties of the formation fluid at the temperature and pressure of the formation fluid in the flowline. The second data characterizes properties of the formation fluid affected by contamination of mud filtrate in the formation fluid. The data processing system operates on the second data to derive third data characterizing properties of the formation fluid unaffected by contamination of mud filtrate in the formation fluid. The first data, second data, and third data are derived without sampling and analysis of formation fluid at another location within the borehole. The first data, second data, and third data can be derived in real-time for real-time analysis of the formation fluid at the given location within the borehole in conjunction with the sampling of the formation fluid at the given location within the borehole.

According to one embodiment of the invention, the properties represented by the second and third data are selected from the group including hydrocarbon component weight fractions, live fluid density, live fluid viscosity, gas-oil ratio, API gravity, and oil formation volume factor.

In another embodiment of the invention, the method and system derives measurements for the temperature and pressure of the formation fluid in the earth formation, and the data processing system derives fourth data characterizing at least one property of the formation fluid at the temperature and pressure of the formation fluid in the earth formation based on corresponding third data. Such fourth data characterizes the at least one property of the formation fluid unaffected by contamination of mud filtrate in the formation fluid. Preferably, the at least one property is selected from the group including live fluid density and live fluid viscosity.

According to yet another embodiment of the invention, the third data includes a fluid density unaffected by contamination of mud filtrate that is based on a scaling coefficient dependent on measured GOR of the formation fluid. This scaling coefficient accounts for excess volume created during mixing processes, which increases the accuracy of such characterizations for high GOR samples, especially gas condensate.

Additional objects and advantages of the invention will become apparent to those skilled in the art upon reference to the detailed description taken in conjunction with the provided figures.

DETAILED DESCRIPTION OF THE INVENTION

Figure 1A:
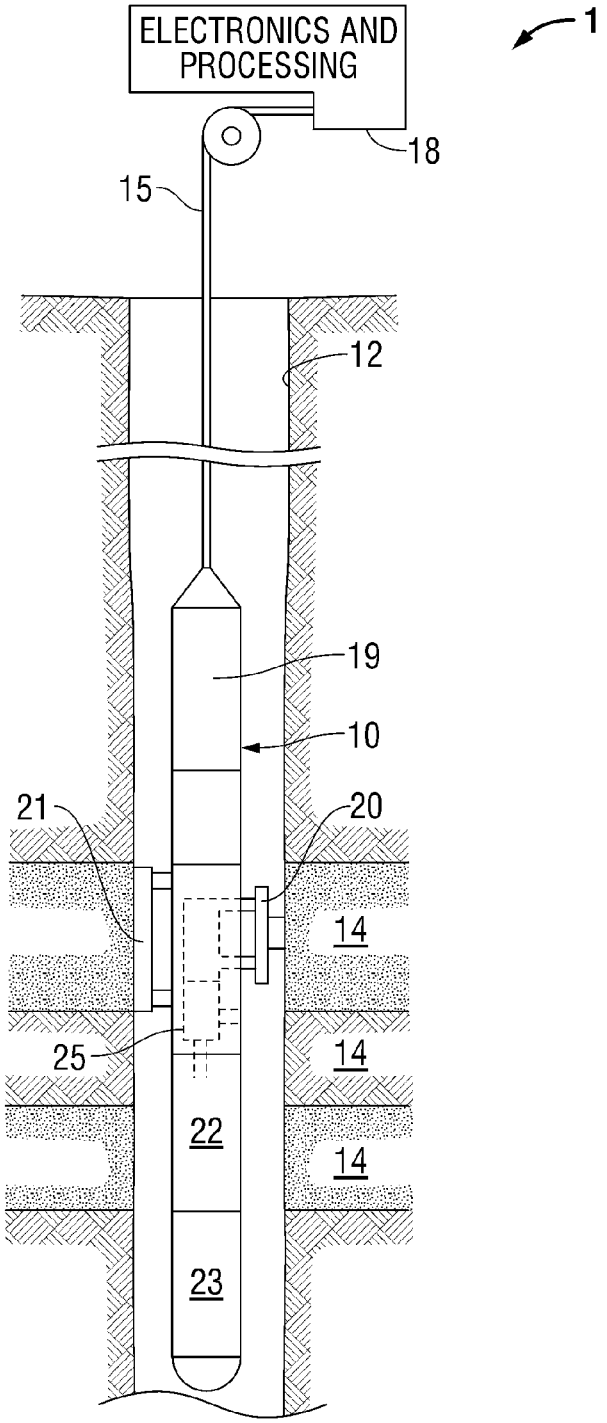
FIG. 1A is a schematic diagram of an exemplary petroleum reservoir analysis system in which the present invention is embodied.

FIG. 1A illustrates an exemplary petroleum reservoir analysis system 1 in which the present invention is embodied. The system 1 includes a borehole tool 10 suspended in the borehole 12 from the lower end of a typical multiconductor cable 15 that is spooled in a usual fashion on a suitable winch (not shown) on the formation surface. The cable 15 is electrically coupled to an electrical control system 18 on the formation surface. The borehole tool 10 includes an elongated body 19 which carries a selectively extendable fluid admitting assembly 20 and a selectively extendable tool anchoring member 21 which are respectively arranged on opposite sides of the tool body 19. The fluid admitting assembly 20 is equipped for selectively sealing off or isolating selected portions of the wall of the borehole 12 such that fluid communication with the adjacent earth formation 14 is established. The fluid admitting assembly 20 and borehole tool 10 include a flowline leading to a fluid analysis module 25. The formation fluid obtained by the fluid admitting assembly 20 flows through the flowline and through the fluid analysis module 25. The fluid may thereafter be expelled through a port (not shown) or it may be sent to one or more fluid collecting chambers 22 and 23 which may receive and retain the fluids obtained from the formation. With the fluid admitting assembly 20 sealingly engaging the formation 14, a short rapid pressure drop can be used to break the mudcake seal. Normally, the first fluid drawn into the borehole tool 10 will be highly contaminated with mud filtrate. As the tool continues to draw fluid from the formation 14, the area near the fluid admitting assembly 20 cleans up and reservoir fluid becomes the dominant constituent. The time required for cleanup depends upon many parameters, including formation permeability, fluid viscosity, the pressure differences between the borehole and the formation, and overbalanced pressure difference and its duration during drilling. Increasing the pump rate can shorten the cleanup time, but the rate must be controlled carefully to preserve formation pressure conditions.

The fluid analysis module 25 includes means for measuring the temperature and pressure of the fluid in the flowline. The fluid analysis module 25 derives properties that characterize the formation fluid sample at the flowline pressure and temperature. In the preferred embodiment, the fluid analysis module 25 measures absorption spectra and translates such measurements into concentrations of several alkane components and groups in the fluid sample. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group, and the lump of hexane and heavier alkane components (C6+). The C3-C5 alkane group includes propane, butane, and pentane. The C6+ alkane group includes hexane ($C_6H_{14}$), heptane ($C_7H_{16}$), octane ($C_8H_{18}$), nonane ($C_9H_{20}$), decane ($C_{10}H_{22}$), hendecane ($C_{11}H_{24}$)— also referred to as endecane or undecane, dodecane ($C_{12}H_{26}$), tridecane ($C_{13}H_{28}$), tetradecane ($C_{14}H_{30}$), pentadecane ($C_{15}H_{32}$), hexadecane ($C_{16}H_{34}$), etc. The fluid analysis module 25 also provides a means that measures volume fraction of water ($v_w$) at the flowline temperature and pressure, volume fraction of oil-based mud ($v_{obm}$) at the flowline temperature and pressure, GOR, API gravity, oil formation volume factor (Bo), live fluid density (ρ) at the flowline temperature and pressure, live fluid viscosity (μ) at flowline temperature and pressure (in cp), formation pressure, and formation temperature.

Control of the fluid admitting assembly 20 and fluid analysis module 25, and the flow path to the fluid collecting chambers 22, 23 is maintained by the control system 18. As will be appreciated by those skilled in the art, the fluid analysis module 25 and the surface-located electrical control system 18 include data processing functionality (e.g., one or more microprocessors, associated memory, and other hardware and/or software) to implement the invention as described herein. The electrical control system 18 can also be realized by a distributed data processing system wherein data measured by the borehole tool 10 is communicated (preferably in real-time) over a communication link (typically a satellite link) to a remote location for data analysis as described herein. The data analysis can be carried out on a workstation or other suitable data processing system (such as a computer cluster or computing grid).

Formation fluids sampled by the borehole tool 10 may be contaminated with mud filtrate. That is, the formation fluids may be contaminated with the filtrate of a drilling fluid that seeps into the formation 14 during the drilling process. Thus, when fluids are withdrawn from the formation 14 by the fluid admitting assembly 20, they may include mud filtrate. In some examples, formation fluids are withdrawn from the formation 14 and pumped into the borehole or into a large waste chamber (not shown) in the borehole tool 10 until the fluid being withdrawn becomes sufficiently clean. A clean sample is one where the concentration of mud filtrate in the sample fluid is acceptably low so that the fluid substantially represents native (i.e., naturally occurring) formation fluids. In the illustrated example, the borehole tool 10 is provided with fluid collecting chambers 22 and 23 to store collected fluid samples.

Figure 1B:
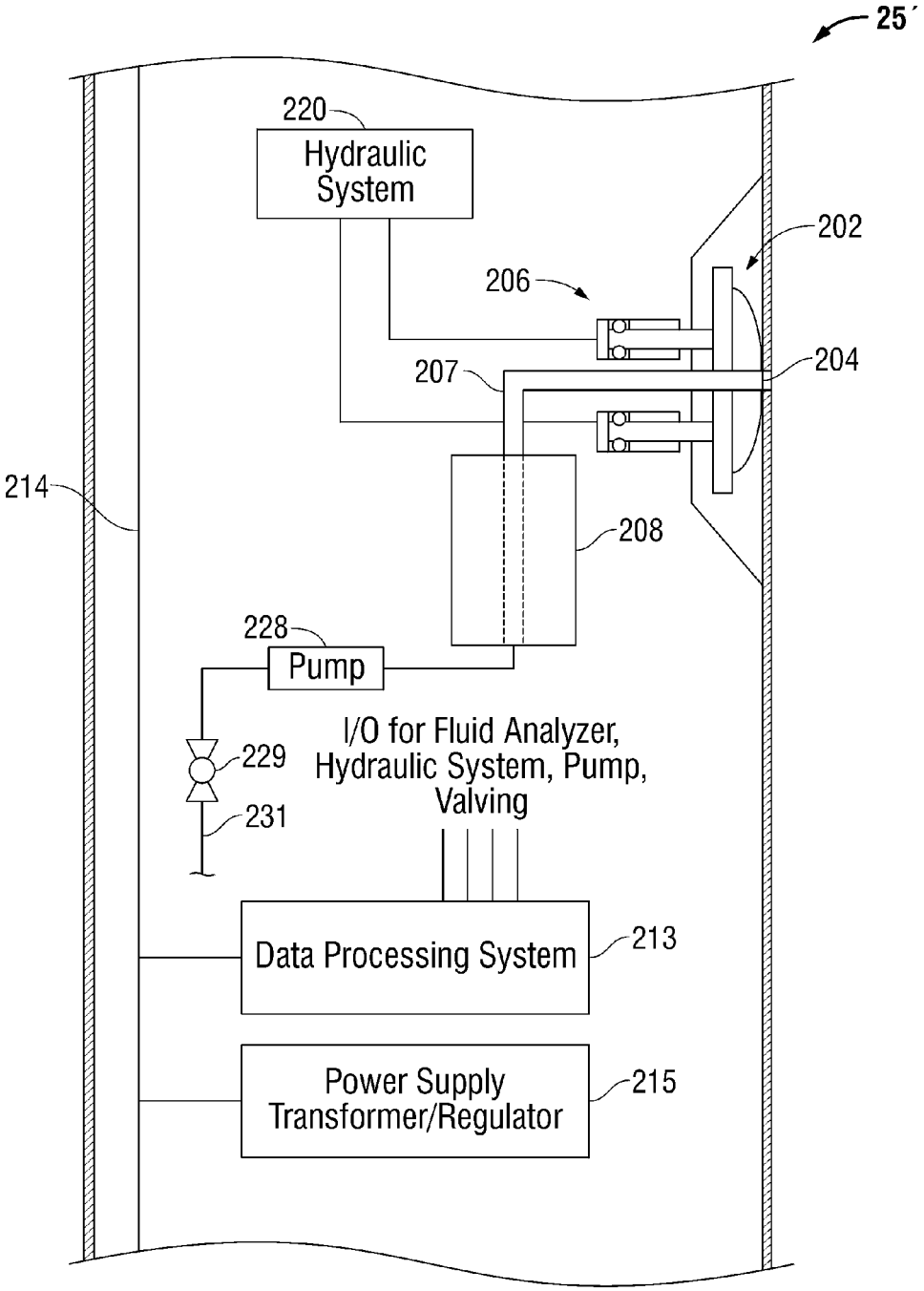
FIG. 1B is a schematic diagram of an exemplary fluid analysis module suitable for use in the borehole tool of FIG. 1A.
Figure 2A:
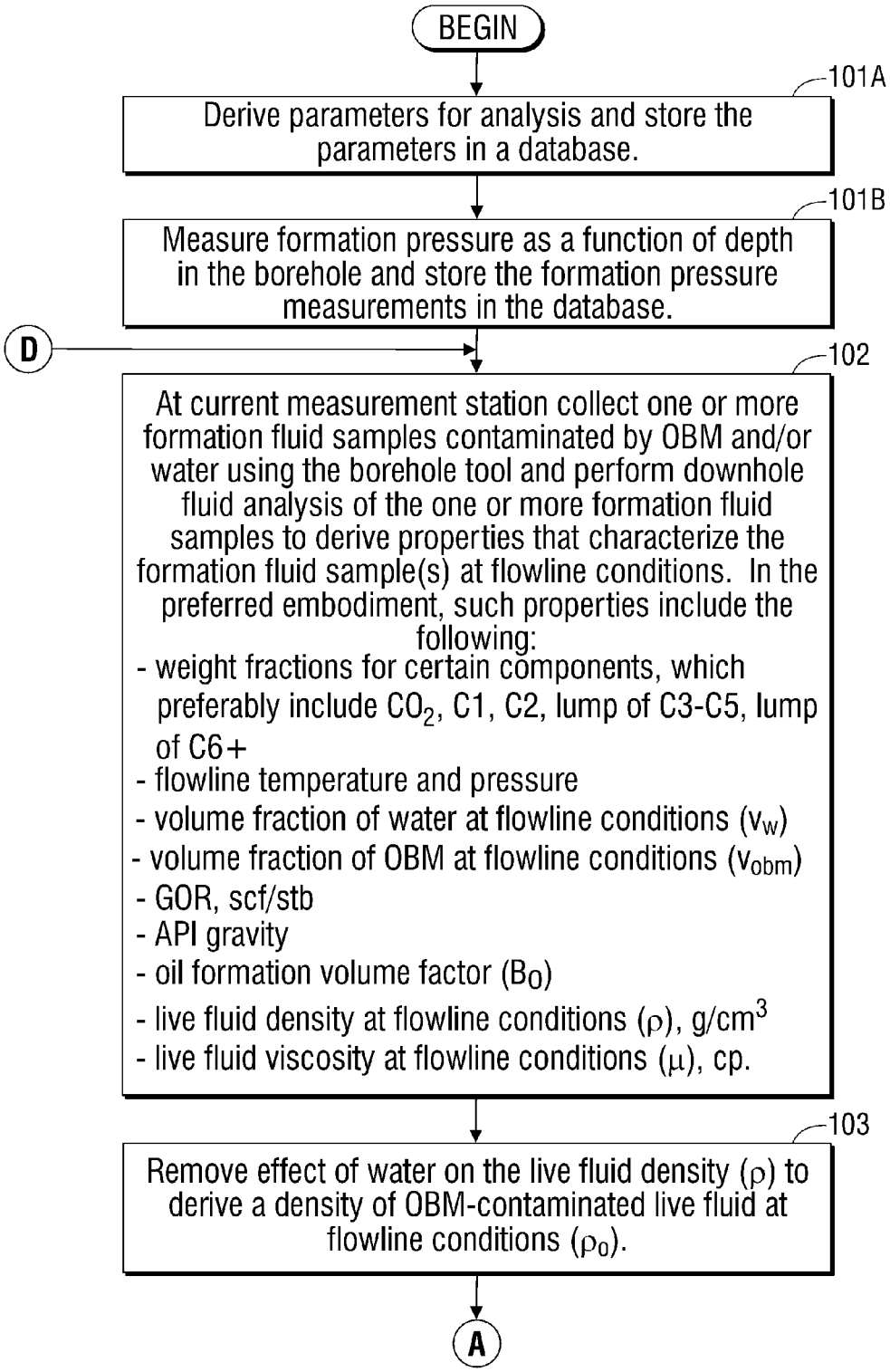
FIGS. 2A-2D, collectively, are a flow chart of operations that characterize the fluid properties of a petroleum reservoir of interest based upon downhole fluid analysis of samples of reservoir fluid contaminated with drilling mud in accordance with the present invention.
Figure 2B:
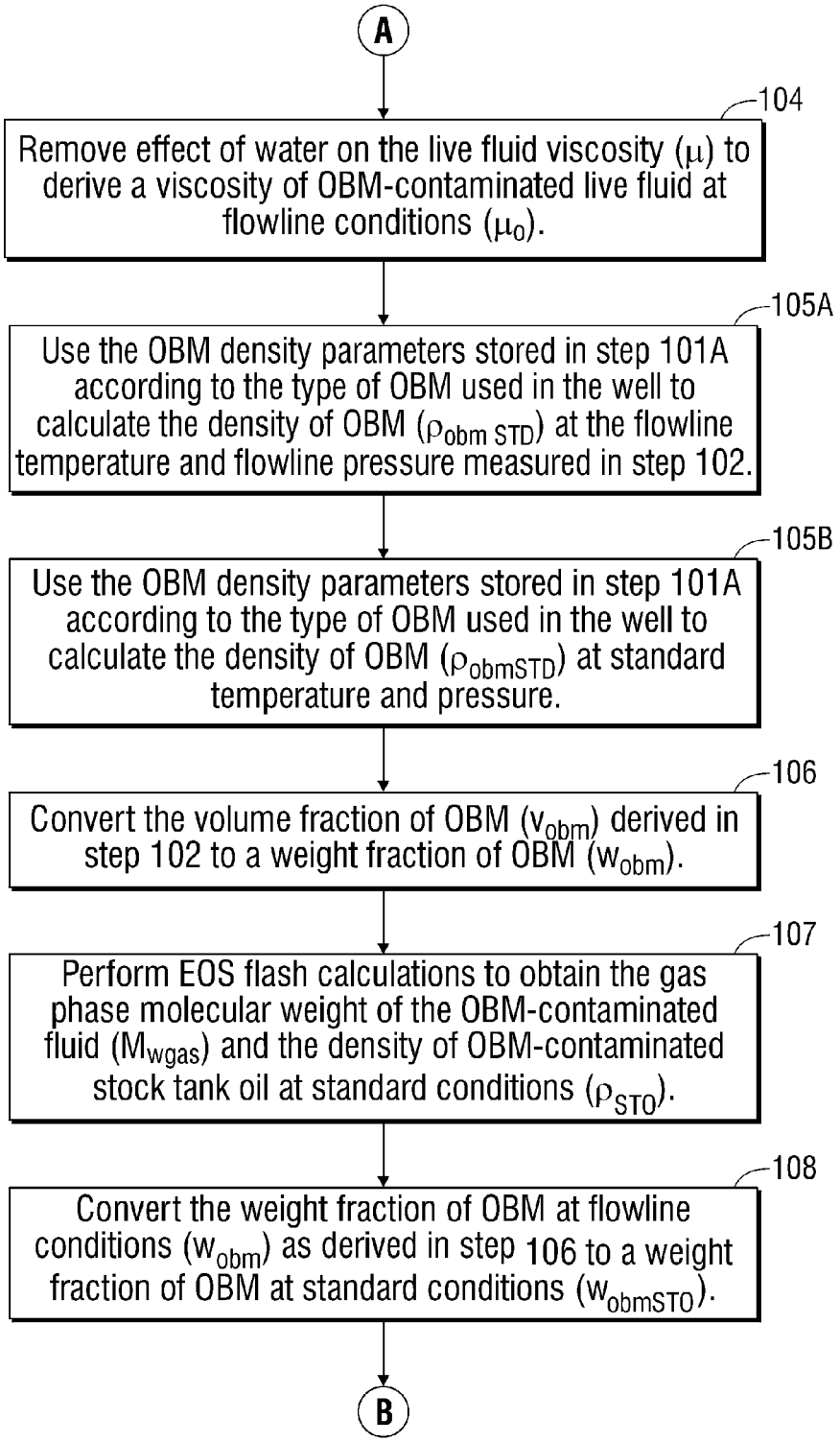
Figure 2C:
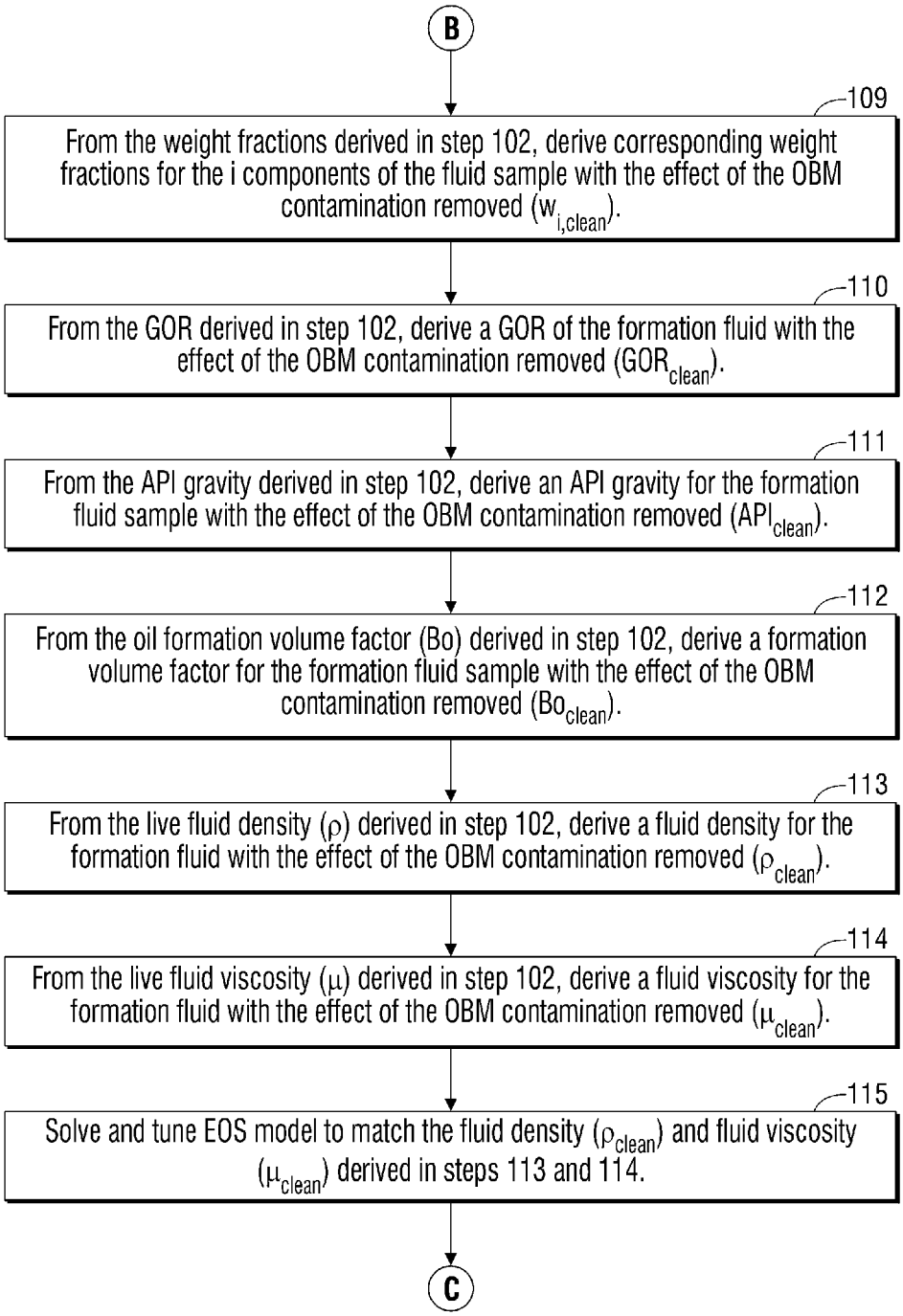
Figure 2D:
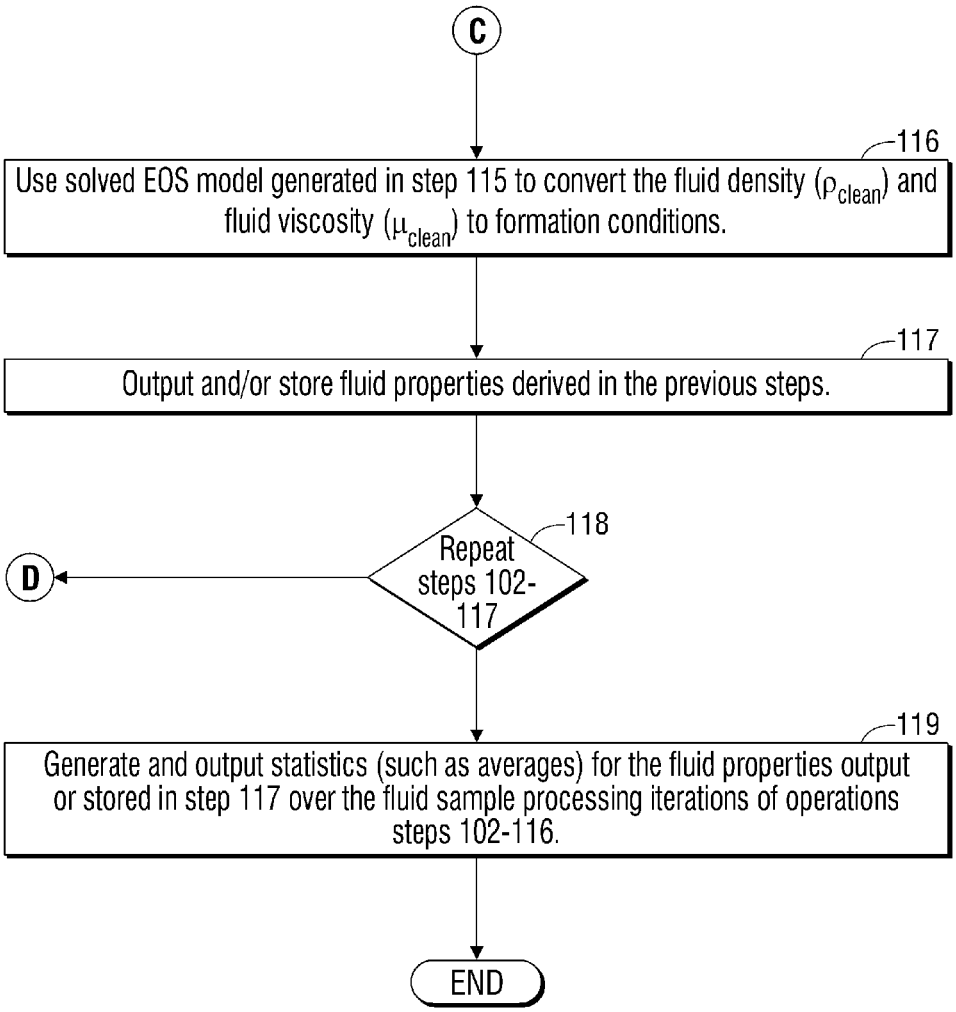

FIG. 1B illustrates an exemplary embodiment of the fluid analysis module 25 of FIG. 1A (labeled 25'), including a probe 202 having a port 204 to admit formation fluid therein. A hydraulic extending mechanism 206 may be driven by a hydraulic system 220 to extend the probe 202 to sealingly engage the formation 14 (FIG. 1A). In alternative implementations, more than one probe can be used or inflatable packers can replace the probe(s) and function to establish fluid connections with the formation and sample fluid samples.

The probe 202 can be realized by the Quicksilver Probe available from Schlumberger Technology Corporation. The Quicksilver Probe divides the fluid flow from the reservoir into two concentric zones, a central zone isolated from a guard zone about the perimeter of the central zone. The two zones are connected to separate flowlines with independent pumps. The pumps can be run at different rates to exploit filtrate/fluid viscosity contrast and permeability anisotropy of the reservoir. Higher intake velocity in the guard zone directs contaminated fluid into the guard zone flowline, while clean fluid is drawn into the central zone. Fluid analyzers analyze the fluid in each flowline to determine the composition of the fluid in the respective flowlines. The pump rates can be adjusted based on such compositional analysis to achieve and maintain desired fluid contamination levels. The operation of the Quicksilver Probe efficiently separates contaminated fluid from cleaner fluid early in the fluid extraction process, which results in obtaining clean fluid in much less time compared to traditional formation testing tools.

The fluid analysis module 25' includes a flowline 207 that carries formation fluid from the port 204 through a fluid analyzer 208. The fluid analyzer 208 includes a light source that directs light to a sapphire prism disposed adjacent the flowline fluid flow. The reflection of such light is analyzed by a gas refractometer and dual fluoroscene detectors. The gas refractometer qualitatively identifies the fluid phase in the flowline. At the selected angle of incidence of the light emitted from the diode, the reflection coefficient is much larger when gas is in contact with the window than when oil or water is in contact with the window. The dual fluoroscene detectors detect free gas bubbles and retrograde liquid dropout to accurately detect single phase fluid flow in the flowline 207. Fluid type is also identified. The resulting phase information can be used to define the difference between retrograde condensates and volatile oils, which can have similar GOR's and live oil densities. It can also be used to monitor phase separation in real time and ensure single phase sampling. The fluid analyzer 208 also includes dual spectrometers—a filter-array spectrometer and a grating-type spectrometer.

The filter-array spectrometer of the analyzer 208 includes a broadband light source providing broadband light that passes along optical guides and through an optical chamber in the flowline 207 to an array of optical density detectors that are designed to detect narrow frequency bands (commonly referred to as channels) in the visible and near-infrared spectra as described in U.S. Pat. No. 4,994,671. Preferably, these channels include a subset of channels that detect water absorption peaks (which are used to characterize water content in the fluid) as well as a dedicated channel corresponding to the absorption peak of $CO_2$ with dual channels above and below this dedicated channel that subtract out the overlapping spectrum of hydrocarbon and small amounts of water (which are used to characterize $CO_2$ content in the fluid). The filter-array spectrometer also employs optical filters that provide for identification of the color of the fluid in the flowline 207. Such color measurements support fluid identification, determination of asphaltene gradients, and pH measurement. Mud filtrates or other solid materials generate noise in the channels of the filter-array spectrometer. Scattering caused by these particles is independent of wavelength. In the preferred embodiment, the effect of such scattering can be removed by subtracting a nearby channel.

The grating-type spectrometer of the analyzer 208 is designed to detect channels in the near-infrared spectra (preferably between 1600-1800 nm) where reservoir fluid has absorption characteristics that reflect molecular structure.

The analyzer 208 also includes a pressure sensor for measuring pressure of the formation fluid in the flowline 207, a temperature sensor for measuring temperature of the formation fluid in the flowline 207, and a density sensor for measuring live fluid density of the fluid in the flowline 207. In the preferred embodiment, the density sensor is realized by a vibrating sensor that oscillates in two perpendicular modes within the fluid. Simple physical models describe the resonance frequency and quality factor of the sensor in relation to live fluid density. Dual mode oscillation is advantageous over other resonant techniques because it minimizes the effects of pressure and temperature on the sensor through common mode rejection. In addition to density, the density sensor can also provide a measurement of fluid viscosity from the quality factor of oscillation frequency. Note that viscosity is often measured by placing a vibrating object in the fluid flow and measuring the increase in line width of any fundamental resonance. This increase in line width is related closely to the viscosity of the fluid. The change in frequency of the vibrating object is closely associated with the mass density of the object. If density is measured independently, then the determination of viscosity is more accurate because the effects of a density change on the mechanical resonances are determined. Generally, the response of the vibrating object is calibrated against known standards. The fluid analyzer 208 can also measure resistivity and pH of fluid in the flowline 207. In the preferred embodiment, the fluid analyzer 208 is realized by the InSitu Fluid Analyzer available from Schlumberger Technology Corporation. In other exemplary implementations, the flowline sensors of the fluid analyzer 208 may be replaced or supplemented with other types of suitable measurement sensors (e.g., NMR sensors or capacitance sensors). Pressure sensor(s) and/or temperature sensor(s) for measuring pressure and temperature of fluid drawn into the flowline 207 can also be part of the probe 202.

A pump 228 is fluidly coupled to the flowline 207 and is controlled to draw formation fluid into the flowline 207 and possibly to supply formation fluid to the fluid collecting chambers 22 and 23 (FIG. 1A) via valve 229 and flowpath 231 (FIG. 1B).

The fluid analysis module 25' includes a data processing system 213 that receives and transmits control and data signals to the other components of the fluid analysis module 25' for controlling operations of the module 25'. The data processing system 213 also interfaces to the fluid analyzer 208 for receiving, storing and processing the measurement data generated therein. In the preferred embodiment, the data processing system 213 processes the measurement data output by the fluid analyzer 208 to derive and store measurements of the hydrocarbon composition of fluid samples analyzed insitu by the fluid analyzer 208, including concentrations (e.g., weight percentages) of carbon dioxide ($CO_2$), methane ($CH_4$), ethane ($C_2H_6$), the C3-C5 alkane group, and the lump of hexane and heavier alkane components (C6+), flowline temperature and flowline pressure, volume fraction of water ($v_w$) at the flowline temperature and pressure, volume fraction of oil-based mud ($v_{obm}$) at the flowline temperature and pressure, GOR, API gravity, oil formation volume factor (Bo), live fluid density ($\rho$) at the flowline temperature and pressure, live fluid viscosity ($\mu$) at flowline temperature and pressure, and possibly other parameters. The measurements of the hydrocarbon composition of fluid samples are derived by translation of the data output by spectrometers of the fluid analyzer 208. Flowline temperature and pressure are measured by the temperature sensor and pressure sensor, respectively, of the fluid analyzer 208 (and/or probe 202). In the preferred embodiment, the output of the temperature sensor(s) and pressure sensor(s) are monitored continuously before, during, and after sample acquisition to derive the temperature and pressure of the fluid in the flowline 207. The volume fraction of water ($v_w$) at the flowline temperature and pressure is determined by measuring the near-infrared absorption peaks of water, hydrocarbons, $CO_2$ and possible other components. Generally, the fraction of water is given by the magnitude of the two-stretch overtone water peak in comparison to its maximum value when the flowline 207 is filled with water. The volume fraction of oil-based mud ($v_{obm}$) at the flowline temperature and pressure is determined by the measured optical properties of the fluid in the flowline 207 as a function of pumping time in conjunction with a fluid sample cleanup model that estimates filtrate contamination as a function of the measured optical properties and pumping time. In the preferred embodiment, the fluid sample cleanup model follows Beers-Lambert mixing law as described in "Quantifying Contamination using Color of Crude and Condensate," Oilfield Review, published by Schlumberger, Autumn 2001, pg. 24-43. GOR is determined by measuring the quantity of methane and liquid components of crude oil using near infrared absorption peaks. The ratio of the methane peak to the oil peak on a single phase live crude oil is directly related to GOR. API gravity is determined by measuring the frequency shift of a calibrated vibrating object placed in the fluid of interest. The oil formation volume factor (Bo) can be derived from equation of state analysis based on the measurements of the hydrocarbon composition of the formation fluid. It can also be estimated utilizing well known correlations (e.g., Standing, Vasquez and Beggs, Glaso, Al-Marhoun, Petrosky and Farshad, Asgarpour, Dokla and Osman, Obomanu, Farshad, and Kartoatmodjo and Schmidt), from a trained neural network, or from other suitable means. Live fluid density ($\rho$) at the flowline temperature and pressure is determined by the output of the density sensor of the fluid analyzer 208 at the time the flowline temperature and pressure is measured. Live fluid viscosity (μ) at flowline temperature and pressure is derived from the quality factor of the density sensor measurements at the time the flowline temperature and pressure is measured.

Formation pressure as a function of depth in the borehole 12 can be measured as part of a pretest carried out prior to the downhole fluid sampling and analysis at the various measurement stations within the borehole 12 as described herein. The formation temperature is not likely to deviate substantially from the flowline temperature at a given measurement station and thus can be estimated as the flowline temperature at the given measurement station in many applications. Formation pressure can also be measured by the temperature sensor and pressure sensor, respectively, of the fluid analyzer 208 in conjunction with the downhole fluid sampling and analysis at a particular measurement station after buildup of the flowline to formation pressure.

The fluid analysis module 25' also includes a tool bus 214 that communicates data signals and control signals between the data processing system 213 and the surface-located control system 18 of FIG. 1A. The tool bus 214 can also carry electrical power supply signals generated by a surface-located power source for supply to the module 25', and the module 25' can include a power supply transformer/regulator 215 for transforming the electric power supply signals supplied via the tool bus 214 to appropriate levels suitable for use by the electrical components of the module 25'.

Although the components of FIG. 1B are shown and described above as being communicatively coupled and arranged in a particular configuration, persons of ordinary skill in the art will appreciate that the components of the fluid analysis module 25' can be communicatively coupled and/or arranged differently than depicted in FIG. 1B without departing from the scope of the present disclosure. In addition, the example methods, apparatus, and systems described herein are not limited to a particular conveyance type but, instead, may be implemented in connection with different conveyance types including, for example, coiled tubing, wireline, wired drill pipe, and/or other conveyance means known in the industry.

In accordance with the present invention, the system of FIGS. 1A and 1B can be employed with the methodology of FIGS. 2A-2D to characterize the fluid properties of a petroleum reservoir of interest based upon downhole fluid analysis of samples of reservoir fluid contaminated with drilling mud. As will be appreciated by those skilled in the art, the surface-located electrical control system 18 and the fluid analysis module 25 of the borehole tool 10 each include data processing functionality (e.g., one or more microprocessors, associated memory, and other hardware and/or software) that cooperate to implement the invention as described herein. The electrical control system 18 can also be realized by a distributed data processing system wherein data measured by the borehole tool 10 is communicated in real-time over a communication link (typically a satellite link) to a remote location for data analysis as described herein. The data analysis can be carried out on a workstation or other suitable data processing system (such as a computer cluster or computing grid). For simplicity of description, the operations described below characterize fluid samples contaminated by oil-based drilling mud. One skilled in the art will appreciate that such operations can readily be extended to characterize fluid samples contaminated by synthetic-based mud and water-based mud as needed.

In step 101A, the following parameters are derived offline and loaded into a persistent storage (e.g., one or more data files or other suitable electronic data structures) accessible by the data processing functionality of the system:

- $\rho_w$, which is the density of water as a function of temperature and pressure (preferably in g/cm$^3$);
- $\mu_w$, which is the viscosity of water as a function of temperature and pressure (preferably in cp);
- $M_{ww}$, which is the molecular weight of water (18.02 in g/mol);
- $\rho_{obm}$, which is the density of OBM as a function of temperature and pressure (preferably in g/cm$^3$);
- $\mu_{obm}$, which is the viscosity of OBM as a function of temperature and pressure (preferably in cp);
- $M_{wobm}$, which is the molecular weight of OBM for one or more pertinent OBM types (preferably in g/mol);

The water density ($\rho_w$) can be calculated as function of temperature (T in ° F.) and pressure (P in psia) by McCain's correlation:

$$\rho_w = \frac{\rho_w^s}{(1+\Delta V_T)(1+\Delta V_P)} = \frac{0.99901}{(1+\Delta V_T)(1+\Delta V_P)} \tag{1}$$

where $\rho_w$ is the density of water at a specified temperature and pressure, in g/cm$^3$ $\rho^s{}_w$ is the density of water at standard conditions (60 F and 14.696 psia) (0.99901 g/cm$^3$).

$\Delta V_T$ and $\Delta V_P$ can be estimated by:

$$\Delta V_T = -1.0001\times10^{-2} + 1.33391\times10^{-4}T + 5.50654\times10^{-7}T^2 \tag{2}$$

$$\Delta V_P = -1.95301\times10^{-9}PT - 1.72834\times10^{-13}P^2T - 3.58922\times10^{-7}P - 2.25341\times10^{-10}P^2 \tag{3}$$

The water viscosity ($\mu_w$) can be calculated as function of temperature and pressure by McCain's correlation:

$$\mu_w = 109.574T^{-1.2166}(0.9994 + 4.0295\times10^{-5}P + 3.1062\times10^{-9}P^2) \tag{4}$$

where T is in ° F. and P is in psia.

The types of oil-based mud (OBM) commonly used by the industry include diesel, mineral oils, n-paraffins, olefins, esters, and the like. The densities and viscosities of these OBM's can be measured using commercially available fluid PVT analysis setups. The ranges of temperatures and pressures cover all the reservoir and standard conditions.

The experimental density measurements can be correlated by the following polynomial function to derive density of OBM ($\rho_{obm}$) as a function of temperature (T in ° F.) and pressure (P in psia):

$$\rho_{obm} = \sum_{i=0}^{2}\sum_{j=0}^{1} a_{ij}P^iT^j \tag{5}$$

where $a_{ij}$'s are coefficients of the polynomial function, which are regressed by matching the experimental density data for different OBM's.

The experimental viscosity measurements can be correlated by the following polynomial function to derive viscosity of OBM ($\mu_{obm}$) as a function of temperature (T in ° F.) and pressure (P in psia):

$$\mu_{obm} = \alpha_1 T^{\alpha_2}(\log \mathrm{API})^{\alpha_3 \log T - \alpha_4}(\alpha_5 + \alpha_6 P + \alpha_7 P^2) \tag{6}$$

where $a_1$-$a_7$ are coefficients for different OBM's.

Similar correlation can be used to characterize the density and viscosity of other OBM's. Such estimates are loaded into persistent storage accessible by the data processing functionality of the system for use in the subsequent data processing operations of steps 102 to 118.

In step 101B, the formation pressure is measured as a function of depth within the borehole 12 as part of a pretest. Such formation pressure measurements and corresponding depth values (or possibly an empirical relation that is correlated to such pressure measurements and depth values) are loaded into persistent storage accessible by the data processing functionality of the system for use in the subsequent data processing operations of steps 102 to 118. The pretest can be carried out by a separate wireline tool, by operation of the borehole tool 10 without downhole fluid analysis, or by other suitable means.

In step 102, the borehole tool 10 is controlled to obtain one or more formation fluid sample(s) contaminated by OBM and/or water at a measurement station within the borehore 12 at the formation pressure and temperature. The fluid sample is drawn into the flowline of the fluid analysis module 25 of the borehole tool 10. The fluid analysis module 25 derives properties that characterize the formation fluid sample, including concentrations (e.g., weight percentages) of carbon dioxide ($CO_2$), methane ($CH_4$), ethane ($C_2H_6$), the C3-C5 alkane group, and the lump of hexane and heavier alkane components (C6+), flowline temperature and flowline pressure, volume fraction of water ($v_w$) at the flowline temperature and pressure, volume fraction of oil-based mud ($v_{obm}$) at the flowline temperature and pressure, GOR, API gravity, oil formation volume factor (Bo), live fluid density (ρ) at the flowline temperature and pressure, live fluid viscosity (μ) at flowline temperature and pressure, and possibly other parameters.

In step 103, the effect of water on the live fluid density (ρ) is removed to derive a density of OBM contaminated live fluid at flowline conditions ($\rho_o$). The live fluid density (ρ) can be expressed as $$\rho = \sum_{i=1}^{3} \hat{v}_i \rho_i = \hat{v}_{clean}\rho_{clean} + \hat{v}_{obm}\rho_{obm} + \hat{v}_w\rho_w \tag{7}$$

where $\rho_i$ denotes the density of individual fluids (e.g., decontaminated fluid, OBM and water) at flowline conditions in g/cm$^3$, $\hat{v}_i$ is the volume fraction of individual fluids, $\hat{v}_{clean}$ is the volume fraction of decontaminated fluid (with the effect of OBM and water removed), $\rho_{clean}$ is the density of the decontaminated fluid (with the effect of OBM and water removed), $\hat{v}_{obm}$ is the volume fraction of OBM, $\rho_{obm}$ is the density of OBM, $\hat{v}_w$ is the volume fraction of water, and $\rho_w$ is the density of water.

For oil-based mud systems at low GOR level, it is reasonable to assume excess volume of the system, $V^{ex}=0$. The mixing process is approximately ideal mixing. However, $V^{ex}$ cannot be ignored for gas systems. For oil systems at high GOR level, a large amount of gases are soluble in the oil at high pressure (for instance, reservoir pressure). Those mixing processes are not ideal comingling, however. The volume fractions of downhole fluid analysis measurements are not summed up to unity. Therefore the mixing rule of the density can be reformatted as follows:

$$\rho = ((1 - v_{obm})\rho_{clean} + v_{obm}\rho_{obm})(1 - v_w) + v_w\rho_w = \rho_o(1 - v_w) + v_w\rho_w \tag{8}$$

$$\rho_o = (1 - v_{obm})\rho_{clean} + v_{obm}\rho_{obm} = \frac{\rho - v_w\rho_w}{1 - v_w} \tag{9}$$

where $\rho_o$ is the density of OBM-contaminated live fluid at flowline conditions (g/cm$^3$), including the excess volume impact during mixing processes, ρ is the live fluid density at flowline conditions (g/cm$^3$) derived in step 102, and $v_w$ is the volume fraction of water derived in step 102.

Thus, in step 103, Equation (9) can be solved to derive $\rho_o$, the density of OBM-contaminated live fluid at flowline conditions.

In step 104, the effect of water on live fluid viscosity (μ) is removed to derive a viscosity of OBM-contaminated live fluid at flowline conditions ($\mu_o$). Specifically, a mixture of water and an oil phase can have an effective viscosity obtained from the following equation as taught by G. K. Batchelor, "An Introduction to Fluid Dynamics," Cambridge University Press, New York, 1967.

$$\frac{\mu}{\mu_o} = 1 + v_w\frac{\mu_o + 2.5\mu_w}{\mu_o + \mu_w} \tag{10}$$

where $\mu_o$ is the viscosity of OBM-contaminated live fluid at flowline conditions with the effects of water removed (cp), $\mu_w$ is the viscosity of water (cp) as derived in step 101A, and $v_w$ is the volume fraction of water derived in step 102.

In step 104, Equation (10) can be solved for $\mu_o$ to derive a viscosity of OBM-contaminated live fluids at flowline conditions.

In step 105A, the OBM density parameters generated and stored in step 101A for the type of OBM used to drill the sampled borehole are utilized to calculate the density of OBM ($\rho_{obm}$) at the flowline temperature and flowline pressure measured in step 102.

In step 105B, the OBM density parameters generated and stored in step 101A for the type of OBM used to drill the sampled borehole are utilized to calculate the density of OBM ($\rho_{obmSTD}$) at a standard temperature and a standard pressure. In the preferred embodiment, the standard temperature is selected as 60° F. and the standard pressure is selected as 14.696 psia for a reservoir in North America. Other suitable temperatures and pressures can be used as desired.

In Step 106, the volume fraction of OBM ($v_{obm}$) derived in step 102 is converted to a weight fraction of OBM ($w_{obm}$) as follows:

$$w_{obm} = \frac{v_{obm}\rho_{obm}}{\rho - v_w\rho_w} = \frac{v_{obm}\rho_{obm}}{\rho_o} \tag{11}$$

where $\rho_o$ is the density of OBM-contaminated live fluid (without water) as calculated in step 103, $\rho_{obm}$ is the density of OBM at the flowline temperature and flowline pressure as calculated in step 105A, and $v_{obm}$ is the volume fraction of OBM derived in step 102.

This Equation (11) is not only suitable for the single hydrocarbon phase, but also for the two hydrocarbon phases (below bubble or dew points). In the two hydrocarbon phases, $\rho_o$ is the oil (liquid) density at specified conditions and $v_{obm}$ is defined as the volume of OBM divided by that of the contaminated oil at specified conditions.

In step 107, EOS flash calculations are performed to obtain a gas phase molecular weight for OBM-contaminated fluid ($M_{wgas}$) and a density of OBM-contaminated stock tank oil (STO) at standard conditions ($\rho_{STO}$). Such EOS flash calculations are based on EOS equations that represent the functional relationship between pressure, volume and temperature of the fluid sample. The EOS equations can take many forms. For example, they can be any one of many cubic EOS, as is well known. Such cubic EOS include van der Waals EOS (1873), Redlich-Kwong EOS (1949), Soave-Redlich Kwong EOS (1972), Peng-Robinson EOS (1976), Stryjek-Vera-Peng-Robinson EOS (1986), and Patel-Teja EOS (1982). Volume shift parameters can be employed as part of the cubic EOS in order to improve liquid density predictions, as is well known. Mixing rules (such as van der Waals mixing rule) can also be employed as part of the cubic EOS. A statistical associating fluid theory, SAFT-type, EOS can also be used, as is well known in the art. Tuning of the EOS equations can be carried out, which typically involves tuning volume translation parameters, binary interaction parameters, and/or critical properties of the components of the EOS equations. An example of EOS tuning is described in Reyadh A. Almehaideb et al., "EOS tuning to model full field crude oil properties using multiple well fluid PVT analysis," *Journal of Petroleum Science and Engineering*, Volume 26, Issues 1-4, pp. 291-300, 2000. The flash EOS calculations are also based on the properties of a two phase fluid (liquid-vapor) in equilibrium. A condition for such equilibrium is that the chemical potential of each component in each phase are equal. This is equivalent to the fugacity of each component in each phase being equal as well. The fugacity of a component in the mixture can be expressed in terms of a fugacity coefficient. For a mixture of gas and liquid, the fugacity coefficients for the gas and liquid phases can be written as $f_i^v = y_i \phi_i^v P$ and $f_i^L = x_i \phi_i^L P$. The equilibrium condition can be written in terms of an equilibrium ratio ($K_i$) for the components as $$K_i = \frac{y_i}{x_i} = \frac{\phi_i^L}{\phi_i^V}.$$

The fugacity coefficient for the gas phase ($\phi_i^v$) is a function of pressure, temperature and molar gas fraction $y_i$. The fugacity coefficient for the liquid phase ($\phi_i^L$) is a function of pressure, temperature and molar liquid fraction $x_i$. The molar liquid fraction $x_i$ is related to the molar component fraction $z_i$ by $$x_i = \frac{z_i}{1 + \alpha_g(K_i - 1)}$$

where $\alpha_g$ is the gas fraction. And there is a constraint (known as the Rachford-Rice Objective Function) that all mole fractions must add to one as $$\sum_{i=1}^{n} \frac{z_i(K_i - 1)}{1 + \alpha_g(K_i - 1)} = 0.$$

In the preferred embodiment, the flash EOS calculations are carried out over hydrocarbon components that are delumped from the lumps of hydrocarbon components measured by the borehole tool 10 in step 102 in accordance with the delumping operations described in U.S. patent application Ser. No. 12/209,050, filed on Sep. 11, 2008, commonly assigned to the assignee of the present application. These equations are used in conjunction with a phase stability analysis based on the gas fraction $\alpha_g$ that determines whether the fluid is unstable or stable in a single phase. If the fluid is unstable, EOS parameters are calculated at given temperature and pressure, and an initial estimate is made for the equilibrium ratios ($K_i$ values) of the components of the fluid. These K value estimates are used in conjunction with the Rachford-Rice Objective Function to calculate the gas and liquid compositions by the Newton-Raphson method iteration. The gas and liquid compositions are translated to component fugacities in the gas and liquid phases using equations of state. The operations evaluate convergence criteria by determining whether the fugacities of each component in the gas and liquid phase match. If the convergence criteria are not satisfied, the K value estimates are updated and the analysis repeated using the updated K value estimates until the convergence criteria are satisfied. When the convergence criteria are satisfied, the mole fractions of the gas and liquid phases of the component are obtained from the solved component fugacities.

In step 107, the gas phase molecular weight for OBM-contaminated fluid ($M_{wgas}$) is calculated according to the mole fractions of the gas phase for the components (as dictated by the solved component fugacities of the flash EOS calculations) and the component molecular weights as:

$$M_{wgas} = \sum_{i=1}^{n} y_i M_{wi} \tag{12}$$

where $M_{wi}$ is the molecular weight of component i.

Liquid phase molecular weight is calculated according to the mole fractions of the liquid phase for the components (as dictated by the solved component fugacities of the flash EOS calculations) and the component molecular weights as:

$$M_{woil} = \sum_{i=1}^{n} x_i M_{wi} \tag{13}$$

where $M_{wi}$ is the molecular weight of component i.

Liquid molar volume (LMV) is calculated according to the liquid mole fractions of the components and the equations of state. Finally, the density of OBM-contaminated STO at standard conditions ($\rho_{STO}$) is calculated as:

$$\rho_{STO} = M_{woil}/\mathrm{LMV} \tag{14}$$

In step 108, the weight fraction of OBM at flowline conditions ($w_{obm}$) as derived in step 106 is translated to a weight fraction of OBM at standard conditions ($w_{obmSTO}$). The weight fraction of OBM at standard conditions ($w_{obmSTO}$) can be defined as:

$$w_{obmSTO} = \frac{m_{obm}}{m_{STO}} \tag{15}$$

where $m_{obm}$ is the mass of OBM, and $m_{STO}$ is the mass of stock tank oil (STO).

Therefore, the mass of OBM is expressed as:

$$m_{obm}=w_{obmSTO}m_{STO} \tag{16}$$

On the other hand, the weight fraction for OBM at flowline conditions can be given by:

$$\begin{aligned} w_{obm} &= \frac{m_{obm}}{m_{STO}+m_{gas}} = \frac{w_{obmSTO}m_{STO}}{m_{STO}+m_{gas}} = \frac{w_{obmSTO}}{1+\frac{m_{gas}}{m_{STO}}} \\ &= \frac{w_{obmSTO}}{1+\frac{V_{gas}\rho_{gas}}{V_{STO}\rho_{STO}}} = \frac{w_{obmSTO}}{1+\frac{GOR\rho_{gas}}{\rho_{STO}}} \\ &= \frac{w_{obmSTO}}{1+GOR\frac{M_{wgas}P_{STD}}{\rho_{STO}RT_{STD}}} \end{aligned} \tag{17}$$

Therefore, the weight fraction of OBM at standard conditions can be estimated by:

$$w_{obmSTO} = w_{obm}\left(1+GOR\frac{M_{wgas}P_{STD}}{\rho_{STO}RT_{STD}}\right) \tag{18}$$

where GOR is derived in step 102, $M_{wgas}$ is derived in step 107, $\rho_{STO}$ is derived in step 107, $P_{STD}$ is the standard pressure (e.g., 14.696 psia), $T_{STD}$ is the standard temperature (e.g., 60° F.), and R is the universal gas constant.

In step 109, the weight fractions derived in step 102 are translated to corresponding weight fractions with the effect of the OBM contamination removed ($w_{i,clean}$). In the preferred embodiment, the weight fractions with the effect of the OBM contamination removed are defined as:

$$w_{i,clean} = \frac{w_i}{1-w_{obm}} \text{ for } CO2, C1, C2, C3-C5 \tag{19}$$

where $w_i$ is the weight fraction of component i as derived in step 102, and $w_{obm}$ is the weight fraction of OBM derived in step 106

$$w_{C6+,clean} = \frac{w_{C6+}-w_{obm}}{1-w_{obm}} \text{ for } C6+ \tag{20}$$

where $w_{C6+}$ is the weight fraction of lump C6+ as derived in step 102; and $w_{obm}$ is the weight fraction of OBM derived in step 106.

In step 110, the GOR derived in step 102 is translated to GOR with the effect of the OBM and water contamination removed ($GOR_{clean}$) as follows:

$$\begin{aligned} GOR_{clean} &= \frac{V_{gas}}{V_{cleanSTO}} = \frac{V_{gas}}{V_{STO}-V_{obmSTD}} \\ &= \frac{V_{gas}}{V_{STO}\left(1-\frac{\rho_{STO}w_{obmSTO}}{\rho_{obmSTD}}\right)} \\ &= GOR\frac{\rho_{obmSTD}}{\rho_{obmSTD}-\rho_{STO}w_{obmSTO}} \end{aligned} \tag{21}$$

where $\rho_{obmSTD}$ is the density of OBM at a standard temperature and pressure as derived in step 105B, $\rho_{STO}$ is the density of OBM contaminated STO at standard conditions as derived in step 107, and $w_{obmSTO}$ is the weight fraction of OBM at standard temperature and pressure as derived in step 108.

Note that Equation (21) is derived from the definition of $GOR=V_{gas}/V_{STO}$ and Equation (11).

In step 111, the API gravity derived in step 102 is translated to an API gravity with the effect of the OBM and water contamination removed ($API_{clean}$) as follows:

$$\rho_{cleanSTO} = \frac{1-w_{obmSTO}}{\frac{1}{\rho_{STO}}-\frac{w_{obmSTO}}{\rho_{obmSTD}}} \tag{22}$$

$$API_{clean} = \left(\left(\frac{141.5}{\rho_{cleanSTO}}\right)-131.5\right) \tag{23}$$

where $\rho_{obmSTD}$ is the density of OBM at a standard flowline temperature and a standard flowline pressure as derived in step 105B;

$\rho_{STO}$ is the density of contaminated STO at standard conditions as derived in step 107; and $w_{obmSTO}$ is the weight fraction of OBM at standard temperature and pressure as derived in step 108.

In step 112, the oil formation volume factor (Bo) derived in step 102 is translated to an oil formation volume factor with the effect of the OBM and water contamination removed ($Bo_{clean}$) as follows:

$$\begin{aligned} Bo_{clean} &= \frac{V_{clean}}{V_{cleanSTO}} = \frac{V_o-V_{obm}}{V_{STO}-V_{obmSTD}} \\ &= \frac{V_o(1-v_{obm})}{V_{STO}(1-v_{obmSTO})} = Bo\frac{1-v_{obm}}{1-v_{obmSTO}} \\ &= Bo\frac{1-\frac{w_{obm}\rho_o}{\rho_{obm}}}{1-\frac{w_{obmSTO}\rho_{STO}}{\rho_{obmSTD}}} \end{aligned} \tag{24}$$

where $V_o$ and $V_{STO}$ are the volumes of the OBM-contaminated oil at specified pressures and standard conditions, respectively;

$w_{obm}$ is the weight fraction of OBM derived in step 106;

$\rho_o$ is the density of OBM-contaminated live fluid (without water) as calculated in step 103;

$\rho_{obm}$ is the density of OBM at the flowline temperature and flowline pressure as calculated in step 105A;

$w_{obmSTO}$ is the weight fraction of OBM at standard temperature and pressure as derived in step 108;

$\rho_{obmSTD}$ is the density of OBM at a standard flowline temperature and a standard flow pressure as calculated in step 105B; and $\rho_{STO}$ is the density of OBM-contaminated STO at standard conditions as derived in step 107.

In step 113, the live fluid density (ρ) derived in step 102 is translated to a fluid density with the effect of the OBM and water contamination removed ($\rho_{clean}$). If the OBM level is expressed in weight fraction, then the density is given by:

$$\rho = \frac{(1 - v_w)}{\frac{(1 - w_{obm})}{\rho_{clean}} + \frac{w_{obm}}{\rho_{obm}}} + v_w \rho_w \tag{25}$$

Finally, the density of decontaminated live fluids is calculated by:

$$\rho_{clean} = \frac{(1 - w_{obm})}{\frac{1 - v_w}{\rho - v_w \rho_w} - \frac{w_{obm}}{\rho_{obm}}} = \frac{(1 - w_{obm})}{\frac{1}{\rho_o} - \frac{w_{obm}}{\rho_{obm}}} \tag{26}$$

Equation (26) works very well for low GOR oil systems. However, for high GOR systems, due to the excess volume impact during mixing processes, the modified equation is $$\rho_{clean} = \frac{(1 - w_{obm})}{\frac{1 - v_w}{\rho - v_w \rho_w} - \frac{w_{obm}}{\beta \rho_{obm}}} = \frac{(1 - w_{obm})}{\frac{1}{\rho_o} - \frac{w_{obm}}{\beta \rho_{obm}}} \tag{27}$$

Equation (27) introduces a coefficient β. The value of β is determined from laboratory measurements. In the preferred embodiment, β is greater than 1 and is treated as a function of GOR. In an illustrative embodiment, $$\beta = 1 \text{ for GOR} <= 1000 \text{ scf/stb}, \tag{28a}$$

$$\beta > 3.215553\text{E-}09 * \text{GOR} * \text{GOR} - 4.025872\text{E-}06 * \text{GOR} + 1.001199 \tag{28b}$$

for 1000 scf/stb<GOR<10,300 scf/stb, and $$\beta = 1.35 \text{ for GOR} >= 10{,}300 \text{ scf/stb} \tag{28c}$$

In step 114, the live fluid viscosity (μ) derived in step 102 is translated to a fluid viscosity with the effect of the OBM and water contamination removed ($\mu_{clean}$). The viscosity-composition behavior of liquid hydrocarbon mixtures is a concave function that rarely goes through a minimum. The viscosity of a mixture can be estimated by the following mixing rules. For example, the Arrehenius logarithmic mixing rule is given by:

$$\ln \mu_o = \sum_i x_i \ln \mu_i \tag{29}$$

where $x_i$ is the liquid phase mole fraction of component i. The liquid phase mole fraction includes both OBM and decontaminated hydrocarbon fluid. The modified logarithmic mixing rule is given by:

$$\ln \mu_o = \frac{\alpha v_{obm}}{\alpha v_{obm} + 1 - v_{obm}} \ln \mu_{obm} + \left(1 - \frac{\alpha v_{obm}}{\alpha v_{obm} + 1 - v_{obm}}\right) \ln \mu_{clean} \tag{30}$$

where α is the adjustable parameter, which can be determined by matching laboratory data.

The power mixing rule, expressed as Equation (31), can be more accurate than the logarithmic mixing rule.

$$\mu_o = (x_{obm} \mu_{obm}{}^n + (1 - x_{obm}) \mu_{clean}{}^n)^{1/n} \tag{31}$$

where n can be ⅓ or ½.

Recently, a new power mixing rule for viscosity has been proposed as follows:

$$\mu_o = \left(\sum_i x_i \left(\sum_j x_j \sqrt{\mu_i \mu_j}\right)^{-5/3}\right)^{-6/5} \tag{32}$$

Equation (30), (31), or (32) can be used to solve for $\mu_{clean}$. The mole fractions of OBM and reservoir fluid are estimated by:

$$x_{obm} = \frac{w_{obm} M_w}{M_{wobm}} = \frac{\frac{v_{obm} \rho_{obm}}{\rho_o} M_w}{M_{wobm}} \tag{33}$$

$$x_{clean} = 1 - x_{obm} \tag{34}$$

In the preferred embodiment, $x_{obm}$ and $x_{clean}$ are estimated by Equations (33 and 34), $\mu_{obm}$ is calculated by Equation (6) at the flowline temperature and pressure, and $\mu_o$ is derived from step 104. $x_{obm}$ and $x_{clean}$, $\mu_{obm}$ and $\mu_o$ are used in conjunction with one of the mixing rules of Equations (30), (31) or (32) with Newton's method to solve for $\mu_{clean}$.

In step 115, EOS calculations are performed to translate the fluid density $\rho_{clean}$ derived in step 113 to the formation temperature and formation pressure at the depth of the given measurement station. In the preferred embodiment, the formation pressure at the depth of the given measurement station is derived from the formation pressure (or an empirical relation) stored in the database in step 101B. Alternatively, the formation pressure at the depth of the given measurement station can be measured by the fluid analyzer in conjunction with the downhole fluid sampling and analysis at a particular measurement station after buildup of the flowline to formation pressure. The formation temperature is not likely to deviate substantially from the flowline temperature at a given measurement station and thus can be estimated as the flowline temperature at the given measurement station in many applications. EOS calculations are also performed to translate the fluid viscosity $\mu_{clean}$ derived in step 114 to the formation temperature and formation pressure. Such EOS calculations are based on EOS equations that represent the functional relationship between pressure, volume, and temperature of the fluid sample. The EOS equations can take many forms as described above. For translating fluid density, the EOS equations include volume translation parameters that model fluid density as a function of pressure and temperature. For translating fluid viscosity, various viscosity models can be used, such as the corresponding states viscosity model and the Lohrenz-Bray-Clark viscosity model. Such EOS equations are tuned to match one or more points of measured data. In the preferred embodiment, the EOS calculations are carried out over hydrocarbon components that are delumped from lumps of hydrocarbon components measured by the borehole tool 10 in step 102 in accordance with the delumping operations described in U.S. patent application Ser. No. 12/209,050, filed on Sep. 11, 2008.

For example, in translating fluid density, the Peng-Robinson EOS equations with volume translation parameters can be used to model fluid density of reservoir fluids as a function of pressure and temperature when tuned to match one point of the measured data. In this example, the Peng-Robinson EOS equations with volume translation parameters are tuned to match the fluid density $\rho_{clean}$ at the flowline temperature and pressure. Once tuned, the EOS equations with volume translation parameters are used to derive the density of the decontaminated live fluid at the formation temperature and pressure measured in step 102.

In another example, in translating fluid viscosity, a corresponding states viscosity model with one reference fluid (methane) can be used to model viscosity of reservoir fluids as a function of pressure and temperature when tuned to match one point of measured data. In this example, the corresponding states viscosity model is tuned to match the fluid viscosity $\mu_{clean}$ at the flowline temperature and pressure. Once tuned, the corresponding states viscosity model is used at step 116 to derive the viscosity of the decontaminated live fluid at the formation temperature and pressure measured in step 102.

In step 117, a set of fluid properties calculated in the previous steps are stored and preferably output for display to a user for evaluation of the formation fluids at the given measurement station. These properties preferably include the following:

- $w_{i,clean}$ for the i hydrocarbon components of the fluid, which is the weight fraction of component i of decontaminated hydrocarbon fluids;
- $\rho_{clean}$ at formation temperature and pressure, which is the density of decontaminated live fluids at the formation conditions (preferably in g/cm$^3$);
- $\mu_{clean}$ at formation temperature and pressure, which is the viscosity of decontaminated live fluids at formation conditions (preferably in cp);
- $w_{obm}$, which is the weight fraction of OBM at flowline conditions;
- $GOR_{clean}$, which is the GOR of decontaminated fluid (preferably in scf/stb);
- $API_{clean}$, which is the API gravity of decontaminated fluids;
- $Bo_{clean}$, which is the formation volume factor (FVF) of decontaminated fluids;
- $\rho_{cleanSTO}$, which is the density of decontaminated STO (stock tank oil) at standard conditions (preferably in g/cm$^3$);
- $\rho_o$, which is the density of OBM-contaminated live fluids at flowline conditions (preferably in g/cm$^3$);
- $\mu_o$, which is the viscosity of OBM-contaminated live fluids at flowline conditions (in cp);
- $w_{obmSTO}$, which is the weight fraction of OBM at standard conditions based on STO.

In step 118, a criterion is evaluated to determine whether the operations of steps 102-117 should be repeated for additional formation fluid sample(s) at the current measurement station, or possibly at a different measurement station for reservoir fluid analysis at varying depths. If evaluation of the criterion determines that the operations of steps 102-117 should be repeated, the operations return to step 102 for repeating the processing of steps 102-117 for additional formation fluid sample(s) at the current measurement station (or at a different measurement station for reservoir fluid analysis at varying depths within the borehole 12). Otherwise, the operations continue to step 119.

In step 119, statistics (such as averages) for the fluid properties stored (or output) in step 117 over the fluid sample processing iterations of steps 102-116 are generated, stored and preferably output for display to a user for evaluation of the formation fluids.

The operations of FIGS. 2A-2D were validated with experimental data as follows. First, the density and viscosity of five oil-based muds were measured over a wide range of temperatures and pressures. The three types of virgin reservoir fluids (heavy oil, crude oil, and gas condensate) were mixed with different levels of the five OBM's, and detailed PVT properties were measured over a wide range of conditions. Such data was used to obtain the density and viscosity correlations of OBM and validate the methods described herein.

With respect to validating the derivation of live fluid density corrected for contamination by mud filtrates, drilling mud concentration in the mixtures based on STO mass were converted to drilling mud concentrations based on live fluid mass in terms of GOR (gas-oil ratio), STO density, and gas specific gravity. Then the live fluid densities were corrected for the effect of drilling mud contamination as set forth herein. The results are shown in Table 1 using the ideal mixing rules of Equation (26). It is found that the ideal mixing rules work well for low GOR systems (e.g., GOR<1000 scf/stb). However, the deviations become bigger at high OBM levels for gas condensate systems. This means that the excess volume of mixing cannot be ignored.

TABLE 1

Deviation of Live Fluid Densities Corrected for OBM Contamination

| | | Density Deviation, % | | |
|---|---|---|---|---|
| Fluid Type | OBM Type | 10 wt % | 25 wt % | 40 wt % |
| Heavy Oil | Esters | 0.14 | 0.14 | 0.51 |
| Heavy Oil | Mineral Oils | 0.12 | 0.53 | 0.42 |
| Heavy Oil | Olefins | 0.12 | 0.36 | 0.57 |
| Black Oil | Esters | 0.35 | 0.67 | 0.66 |
| Black Oil | Mineral Oils | 0.22 | 0.31 | 0.35 |
| Black Oil | Olefins | 0.17 | 0.19 | 0.31 |
| Gas Condensate | Esters | 0.61 | 3.65 | 4.60 |
| Gas Condensate | Mineral Oils | 0.49 | 1.26 | 4.01 |
| Gas Condensate | Olefins | 0.40 | 0.97 | 3.42 |

When modified mixing rules of Equation (27) are used to derive live fluid density corrected for drilling mud contamination, improved results are obtained for gas condensate systems. The results are shown in Table 2.

TABLE 2

Deviation of Live Fluid Densities Corrected for OBM Contamination for Gas Condensate

| | | Density Deviation, % | | |
|---|---|---|---|---|
| Fluid Type | OBM Type | 10 wt % | 25 wt % | 40 wt % |
| Gas Condensate | Esters | 0.41 | 2.40 | 2.70 |
| Gas Condensate | Mineral Oils | 0.33 | 0.43 | 2.09 |
| Gas Condensate | Olefins | 0.27 | 0.49 | 1.67 |

Table 3 gives the deviation of GOR corrected for drilling mud contamination as calculated according to the methodology herein in comparison to the experimental data. The calculated results are in good agreement with the experimental data.

TABLE 3

Deviation of GOR Corrected for OBM Contamination

| | | GOR Deviation, % | | |
|---|---|---|---|---|
| Fluid Type | OBM Type | 10 wt % | 25 wt % | 40 wt % |
| Heavy Oil | Esters | 1.22 | 4.57 | 2.93 |
| Heavy Oil | Mineral Oils | 0.64 | 1.97 | 2.92 |
| Heavy Oil | Olefins | 1.21 | 6.15 | 3.41 |
| Black Oil | Esters | 1.14 | 1.95 | 4.37 |
| Black Oil | Mineral Oils | 0.96 | 4.33 | 3.36 |

TABLE 3-continued

| Deviation of GOR Corrected for OBM Contamination | | | | |
|---|---|---|---|---|
| | | GOR Deviation, % | | |
| Fluid Type | OBM Type | 10 wt % | 25 wt % | 40 wt % |
| Black Oil | Olefins | 0.89 | 4.36 | 3.26 |
| Gas Condensate | Esters | 4.78 | 0.27 | 0.67 |
| Gas Condensate | Mineral Oils | 5.45 | 2.35 | 3.64 |
| Gas Condensate | Olefins | 6.74 | 4.43 | 1.34 |

Table 4 gives the deviation of API gravity corrected for drilling mud contamination as calculated according to the methodology herein in comparison to the experimental data. The calculated results are in good agreement with the experimental data.

TABLE 4

| Deviation of API Gravity Corrected for OBM Contamination | | | | |
|---|---|---|---|---|
| | | API Deviation, % | | |
| Fluid Type | OBM Type | 10 wt % | 25 wt % | 40 wt % |
| Heavy Oil | Esters | 3.58 | 0.44 | 0.54 |
| | Mineral Oils | 0.74 | 0.56 | 0.11 |
| | Olefins | 0.84 | 1.99 | 1.44 |
| Black Oil | Esters | 1.21 | 1.88 | 5.54 |
| | Mineral Oils | 0.83 | 0.31 | 2.97 |
| | Olefins | 4.32 | 3.36 | 2.38 |
| Gas Condensate | Esters | 3.39 | 1.49 | 2.54 |
| | Mineral Oils | 1.93 | 0.31 | 1.11 |
| | Olefins | 1.28 | 1.28 | 1.93 |

Figure 3:
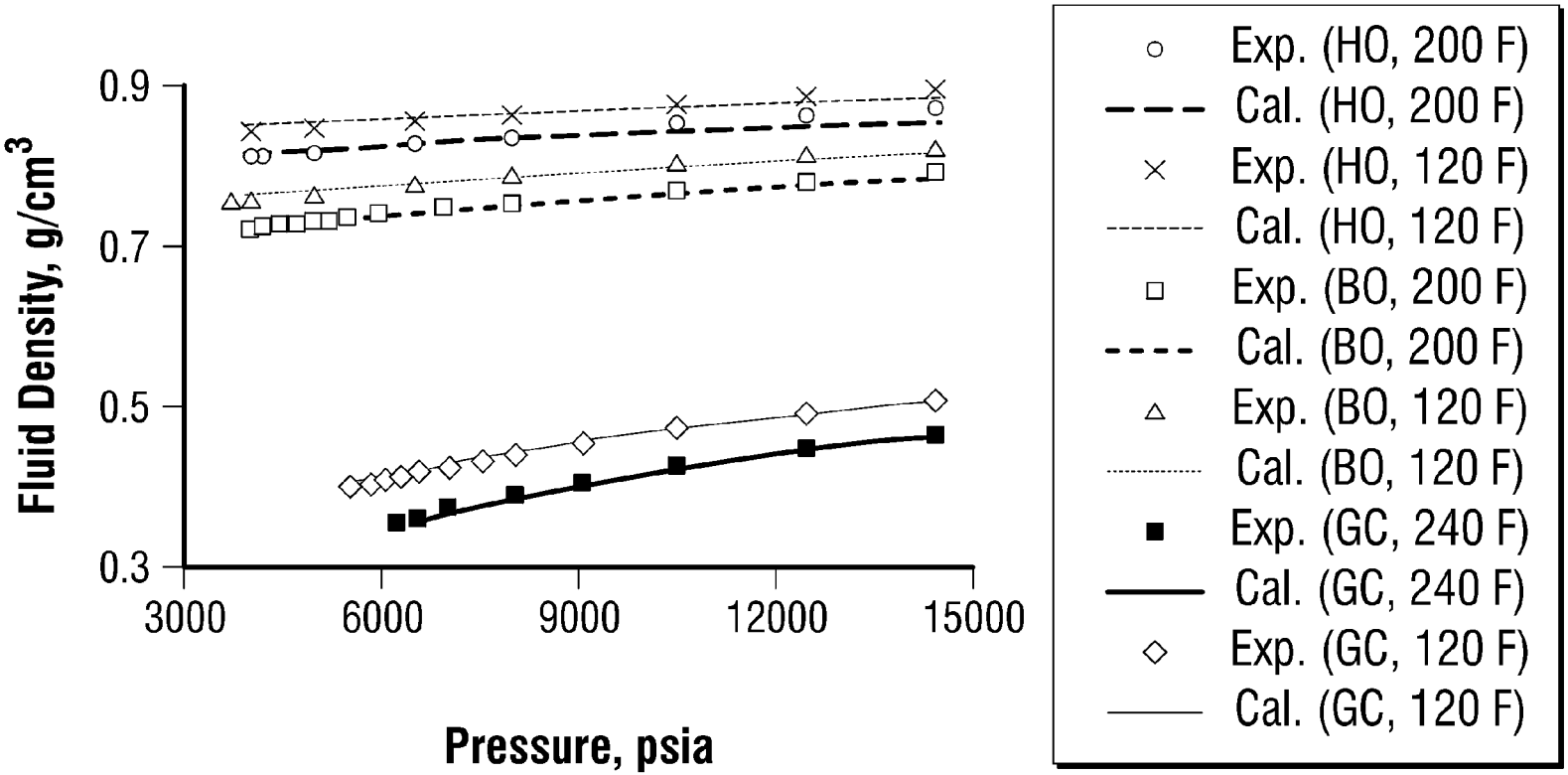
FIG. 3 is a graph illustrating predicted fluid density corrected for drilling mud contamination as a function of pressure relative to experimental live fluid density measurements for three types of fluids (heavy oil (HO), black oil (BO) and gas condensate (GC)).

In order to verify the accuracy of the calculations that translate live fluid density from flowline conditions to other temperatures and pressures, including formation conditions (step 116), three types of fluids (heavy oil (HO), black oil (BO) and gas condensate (GC)) are selected. The fluid density at one condition (temperature and pressure) is matched by tuning the EOS parameter. Then the densities are predicted at other temperatures and pressures. The results are shown in FIG. 3. The average deviation is about 2 percent.

Advantageously, the operations of FIGS. 2A-2D can be carried out in a real-time manner in conjunction with sampling at a measurement station without the need for sampling and analysis of formation fluid at other locations within the borehole. Such real time operations avoid the computational delays associated with the prior art. The operations also characterize a wide array of fluid properties of petroleum samples contaminated with drilling mud in a manner that compensates for the presence of such drilling mud. The operations are also adapted to characterize the viscosity and density of petroleum samples contaminated with drilling mud at formation conditions in a manner that compensates for differences between flowline measurement conditions and formation temperature conditions. The operations also preferably account for excess volume created during mixing processes, which increases the accuracy of such characterizations for high GOR samples, especially gas condensate.

There have been described and illustrated herein a preferred embodiment of a method, system, and apparatus for characterizing the compositional components of a reservoir of interest and analyzing fluid properties of the reservoir of interest based upon its compositional components. While particular embodiments of the invention have been described, it is not intended that the invention be limited thereto, as it is intended that the invention be as broad in scope as the art will allow and that the specification be read likewise. Thus, while particular PVT analyses have been disclosed, it will be appreciated that other PVT analyses can be used as well. In addition, while particular formulations of empirical relations have been disclosed with respect to particular fluid properties, it will be understood that other empirical relations can be used. Furthermore, while particular data processing methodologies and systems have been disclosed, it will be understood that other suitable data processing methodologies and systems can be similarly used. Moreover, while particular equation of state models and calculations have been disclosed for predicting properties of reservoir fluid, it will be appreciated that other equation of state models and calculations could be used as well. It will therefore be appreciated by those skilled in the art that yet other modifications could be made to the provided invention without deviating from its scope as claimed.

What is claimed is:

1. A method for characterizing formation fluid in an earth formation surrounding a borehole drilled into the earth formation, the method comprising:

drawing formation fluid into a flowline of a borehole tool disposed at a given location within the borehole, wherein the formation fluid comprises fluid contaminated with mud filtrate;

analyzing the formation fluid in the flowline to derive first data characterizing properties of the formation fluid in the flowline, the first data including data representing temperature and pressure of the formation fluid in the flowline;

deriving, via a processor, second data characterizing a plurality of properties of the formation fluid at the temperature and pressure of the formation fluid in the flowline, the second data based on the first data, and the second data characterizing properties of the formation fluid that include effects from contamination of the mud filtrate in the formation fluid; and deriving, via the processor, third data characterizing the plurality of properties of the formation fluid at the temperature and pressure of the formation fluid in the flowline, the third data based on the second data, and the third data characterizing properties of the formation fluid where the effects from contamination of the mud filtrate in the formation fluid have been removed;

wherein the first data, the second data, and the third data are derived without employing analysis of formation fluid from another location within the borehole.

2. A method according to claim 1, wherein the first data, second data, and third data are derived in real-time for real-time analysis of the formation fluid at the given location within the borehole in conjunction with the sampling of the formation fluid at the given location within the borehole.

3. A method according to claim 1, further comprising storing the third data for subsequent analysis and output.

4. A method according to claim 1, wherein the plurality of properties represented by the second and third data are selected from the group including hydrocarbon component weight fractions, live fluid density, live fluid viscosity, gas-oil ratio, American Petroleum Institute gravity ("API gravity"), and an oil formation volume factor.

5. A method according to claim 1, further comprising deriving measurements of temperature and pressure of the formation fluid in the earth formation.

6. A method according to claim 5, wherein the temperature of the formation fluid in the earth formation is equated to the temperature of the formation fluid in the flowline as derived in b).

7. A method according to claim 5, further comprising:

e) deriving fourth data characterizing at least one property of the formation fluid at the temperature and pressure of the formation fluid in the earth formation, the fourth data based on corresponding third data, and the fourth data characterizing at least one property of the formation fluid unaffected by contamination of mud filtrate in the formation fluid.

8. A method according to claim 7, wherein the at least one property characterized by the fourth data is selected from the group including live fluid density and live fluid viscosity.

9. A method according to claim 8, wherein the fourth data is derived by Equation of State ("EOS") calculations that translate live fluid density at the temperature and pressure of formation fluid in the flowline to live fluid density at the temperature and pressure of the formation fluid in the earth formation.

10. A method according to claim 4, wherein the third data includes fluid density data that characterizes live fluid density of the formation fluid unaffected by contamination of mud filtrate in the formation fluid, the fluid density data derived from a model characterizing fluid density of a number of drilling muds as a function of temperature and pressure, wherein the modul is used to estimate fluid density of drilling mud at the temperature and pressure of the formation fluid in the flowline.

11. A method according to claim 10, wherein the fluid density data is further derived from at least one parameter selected from the group including:

i) weight fraction of drilling mud as part of the formation fluid in the flowline, ii) density of the formation fluid in the flowline unaffected by water contamination in the formation fluid, and iii) a scaling factor based on the gas-oil ratio of the formation fluid in the flowline.

12. A method according to claim 11, wherein the weight fraction of drilling mud as part of the formation fluid in the flowline is calculated according to $$w_{obm} = \frac{v_{obm}\rho_{obm}}{\rho_o}$$

where $w_{obm}$ is the weight fraction of drilling mud as part of the formation fluid in the flowline, $v_{obm}$ is the volume fraction of drilling mud, $\rho_{obm}$ is the density of drilling mud at the temperature and pressure of the formation fluid in the flowline, and $\rho_o$ is the density of the formation fluid in the flowline unaffected by water contamination in the formation fluid.

13. A method according to claim 12, wherein the density of the formation fluid in the flowline unaffected by water contamination in the formation fluid is calculated according to $$\rho_o = \frac{\rho - v_w\rho_w}{1 - v_w}$$

where $\rho_o$ is the density of the formation fluid in the flowline unaffected by water contamination in the formation fluid, $\rho$ is the live fluid density of the formation fluid in the flowline affected by water and drilling mud contamination in the formation fluid, $v_w$ is the volume fraction of water as part of the formation fluid in the flowline, and $\rho_w$ is the density of water at the temperature and pressure of the formation fluid in the flowline.

14. A method according to claim 13, wherein the density of water at the temperature and pressure of the formation fluid in the flowline ($\rho_w$) is derived from a model characterizing fluid density of water as a function of temperature and pressure.

15. A method according to claim 4, wherein the third data includes fluid viscosity data that characterizes live fluid viscosity of the formation fluid unaffected by contamination of mud filtrate in the formation fluid, the fluid viscosity data derived from a model characterizing fluid viscosity of a number of drilling muds as a function of temperature and pressure, wherein the module is used to estimate fluid viscosity of drilling mud at the temperature and pressure of the formation fluid in the flowline.

16. A method according to claim 15, wherein:

the first data includes weight fraction data for a plurality of hydrocarbon components of the formation fluid in the flowline; and the third data is derived from a gas phase molecular weight and a density of contaminated stock tank oil at standard conditions that are both calculated by solving Equation of State (EOS) flash calculations carried out over a plurality of hydrocarbon components whose weight fractions are estimated in accordance with the weight fraction data of the first data.

17. A method according to claim 16, wherein the third data includes a gas-oil ratio unaffected by contamination of mud filtrate in the formation fluid, wherein the gas-oil ratio is derived from the gas phase molecular weight and the density of contaminated stock tank oil at standard conditions.

18. A method according to claim 17, wherein the gas-oil ratio unaffected by contamination of mud filtrate in the formation fluid is calculated as $$GOR_{clean} = GOR\frac{\rho_{obmSTD}}{\rho_{obmSTD} - \rho_{STO}w_{obmSTO}}$$

where

GOR is the gas-oil ratio, $GOR_{clean}$ is the gas-oil ratio unaffected by contamination of mud filtrate in the formation fluid, $\rho_{obmSTD}$ is the density of drilling mud at a standard temperature and pressure, $\rho_{STO}$ is the density of contaminated stock tank oil at standard conditions, and $w_{obmSTO}$ is the weight fraction of drilling mud at standard conditions.

19. A method according to claim 16, wherein the third data includes an API gravity unaffected by contamination of mud filtrate in the formation fluid, wherein the API gravity is derived from the gas phase molecular weight and the fluid density of contaminated stock tank oil at standard conditions.

20. A method according to claim 19, wherein the API gravity unaffected by contamination of mud filtrate in the formation fluid is calculated as $$\rho_{cleanSTO} = \frac{1 - w_{obmSTO}}{\frac{1}{\rho_{STO}} - \frac{w_{obmSTO}}{\rho_{obmSTD}}}$$

$$API_{clean} = \left(\left(\frac{141.5}{\rho_{cleanSTO}}\right) - 131.5\right)$$

where $API_{clean}$ is the API gravity unaffected by contamination of mud filtrate in the formation fluid, $w_{obmSTO}$ is the weight fraction of drilling mud at standard conditions, $\rho_{obmSTD}$ is the density of drilling mud at standard conditions, and $\rho_{STO}$ is the density of contaminated stock tank oil at standard conditions.

21. A method according to claim 16, wherein the third data includes an oil formation volume factor unaffected by contamination of mud filtrate in the formation fluid, wherein the oil formation volume factor is derived from the gas phase molecular weight and the density of contaminated stock tank oil at standard conditions.

22. A method according to claim 21, wherein the oil formation volume factor unaffected by contamination of mud filtrate in the formation fluid is calculated as $$Bo_{clean} = Bo\frac{1 - \frac{w_{obm}\rho_o}{\rho_{obm}}}{1 - \frac{w_{obmSTO}\rho_{STO}}{\rho_{obmSTD}}}$$

where $Bo_{clean}$ is the oil formation volume factor unaffected by contamination of mud filtrate in the formation fluid, Bo is an oil formation volume factor affected by contamination of mud filtrate in the formation fluid, $w_{obmSTO}$ is the weight fraction of drilling mud at standard conditions, $\rho_{obmSTD}$ is the density of drilling mud at standard conditions, $\rho_{STO}$ is the density of contaminated stock tank oil at standard conditions, $w_{obm}$ is the weight fraction of drilling mud as part of the formation fluid in the flowline, $\rho_{obm}$ is the density of drilling mud at the temperature and pressure of the formation fluid in the flowline, and $\rho_o$ is the density of the formation fluid in the flowline unaffected by water contamination in the formation fluid.

23. A method according to claim 1, further comprising generating and storing statistics for fluid properties of the formation fluid for subsequent analysis and output, the statistics based on the third data characterizing formation fluid at different locations in the borehole.

24. A method according to claim 7, further comprising generating and storing statistics for fluid properties of the formation fluid for subsequent analysis and output, the statistics based on the fourth data characterizing formation fluid at different locations in the borehole.

25. A system for characterizing formation fluid in an earth formation surrounding a borehole drilled into the earth formation, the system comprising:

a borehole tool positionable at different locations in the borehole, the borehole tool including a fluid sampling device for sampling formation fluid at a given location by drawing formation fluid into a flowline disposed therein, and a fluid analyzer for analyzing the formation fluid in the flowline to derive first data characterizing properties of the formation fluid in the flowline, the first data including data representing temperature and pressure of the formation fluid in the flowline, wherein the formation fluid comprises fluid contaminated with mud filtrate;

a data processing system operably coupled to the fluid analyzer, the data processing system adapted to derive second data and third data characterizing a plurality of properties of the formation fluid at the temperature and pressure of the formation fluid in the flowline, wherein the second data is based on the first data and the second data characterizes properties of the formation fluid that include effects from contamination of the mud filtrate in the formation fluid, and wherein the third data is based on the second data and the third data characterizes properties of the formation fluid where the effects from contamination of the mud filtrate in the formation fluid have been removed; and wherein the first data, second data, and third data are derived without employing analysis of formation fluid from another location within the borehole.

26. A system according to claim 25, wherein the first data, second data, and third data are derived in real-time for real-time analysis of the formation fluid at the given location within the borehole in conjunction with the sampling of the formation fluid at the given location within the borehole.

27. A system according to claim 25, wherein the data processing system stores the third data for subsequent analysis and output.

28. A system according to claim 25, wherein the plurality of properties represented by the second and third data are selected from the group including hydrocarbon component weight fractions, live fluid density, live fluid viscosity, gas-oil ratio, API gravity, and an oil formation volume factor.

29. A system according to claim 25, further comprising means for deriving measurements of temperature and pressure of the formation fluid in the earth formation.

30. A system according to claim 25, wherein the data processing system is adapted to derive fourth data characterizing at least one property of the formation fluid at the temperature and pressure of the formation fluid in the earth formation, the fourth data based on corresponding third data, and the fourth data characterizing at least one property of the formation fluid unaffected by contamination of mud filtrate in the formation fluid.

31. A system according to claim 30, wherein the at least one property characterized by the fourth data is selected from the group including live fluid density and live fluid viscosity.

32. A system according to claim 25, wherein said data processing system includes at least a surface-located data processing apparatus.

33. An apparatus for use in a system for characterizing formation fluid in an earth formation surrounding a borehole drilled into the earth formation, the system including a borehole tool positionable at different locations in the borehole, the borehole tool including a fluid sampling device for sampling formation fluid at a given location by drawing formation fluid into a flowline disposed therein, and a fluid analyzer for analyzing the formation fluid in the flowline to derive first data characterizing properties of the formation fluid in the flowline, the first data including data representing temperature and pressure of the formation fluid in the flowline, the apparatus comprising a data processing system operably coupled to the fluid analyzer, the data processing system adapted to derive second data and third data characterizing a plurality of properties of the formation fluid at the temperature and pressure of the formation fluid in the flowline, wherein the second data is based on the first data and the second data characterizes properties of the formation fluid that include effects from contamination of mud filtrate in the formation fluid, wherein the third data is based on the second data and the third data characterizes properties of the formation fluid where the effects from contamination of the mud filtrate in the formation fluid have been removed, and wherein the second data, and third data are derived without sampling and analysis of formation fluid at another location within the borehole.

34. An apparatus according to claim 33, wherein the second data and third data are derived in real-time for real-time analysis of the formation fluid at the given location within the borehole in conjunction with the sampling of the formation fluid at the given location within the borehole.

35. An apparatus according to claim 33, wherein the data processing system stores the third data for subsequent analysis and output.

36. An apparatus according to claim 33, wherein the plurality of properties represented by the second and third data are selected from the group including hydrocarbon component weight fractions, live fluid density, live fluid viscosity, gas-oil ratio, API gravity, and an oil formation volume factor.

37. An apparatus according to claim 33, further comprising means for deriving measurement of temperature and pressure of the formation fluid in the earth formation.

38. An apparatus according to claim 33, wherein the data processing system is adapted to derive fourth data characterizing at least one property of the formation fluid at the temperature and pressure of the formation fluid in the earth formation, the fourth data based on corresponding third data, and the fourth data characterizing at least one property of the formation fluid unaffected by contamination of mud filtrate in the formation fluid.

39. An apparatus according to claim 38, wherein the at least one property characterized by the fourth data is selected from the group including live fluid density and live fluid viscosity.

* * * * *